US011577507B2

(12) United States Patent
Yasuda

(10) Patent No.: US 11,577,507 B2
(45) Date of Patent: Feb. 14, 2023

(54) EJECTION APPARATUS AND EJECTION CONTROL METHOD

(71) Applicant: CANON KABUSHIKI KAISHA, Tokyo (JP)

(72) Inventor: Midori Yasuda, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 86 days.

(21) Appl. No.: 17/335,766

(22) Filed: Jun. 1, 2021

(65) Prior Publication Data

US 2021/0387452 A1 Dec. 16, 2021

(30) Foreign Application Priority Data

Jun. 16, 2020 (JP) ..... JP2020-103905

(51) Int. Cl.
*B41J 2/045* (2006.01)
*B41J 2/21* (2006.01)

(52) U.S. Cl.
CPC ..... *B41J 2/04561* (2013.01); *B41J 2/04586* (2013.01); *B41J 2/2135* (2013.01)

(58) Field of Classification Search
CPC ..... B41J 2/04561; B41J 2/04586; B41J 2/04573; B41J 2/2135
See application file for complete search history.

(56) References Cited

U.S. PATENT DOCUMENTS

2020/0230951 A1* 7/2020 Kobayashi ..... B41J 19/145

FOREIGN PATENT DOCUMENTS

JP 2007-152853 A 6/2007

* cited by examiner

*Primary Examiner* — Thinh H Nguyen
(74) *Attorney, Agent, or Firm* — Canon U.S.A., Inc. I.P. Division

(57) ABSTRACT

An ejection apparatus includes an ejection head having an ejection port, a droplet detection unit, an acquisition unit, a control unit, and a decision unit. The droplet detection unit detects that a droplet ejected from the ejection port has reached a predetermined position. The acquisition unit acquires information regarding a velocity of movement of the detected droplet. The control unit controls the ejection head to eject the droplet from the ejection port. The decision unit decides a number of consecutive ejections of a plurality of droplets from the ejection head based on the acquired information regarding the velocities of each of the plurality of droplets ejected consecutively and detected by the droplet detection unit. If the acquisition unit acquires the information regarding velocities of detected droplets, the control unit controls the ejection head to consecutively eject the droplets from the ejection head based on the decided number of consecutive ejections.

19 Claims, 14 Drawing Sheets

EJECTION APPARATUS AND EJECTION CONTROL METHOD

BACKGROUND

Field

The present disclosure relates to an ejection apparatus and an ejection control method.

Description of the Related Art

In an inkjet-type recording apparatus, continuous usage may cause a change in ejection velocity of ink droplets due to an individual difference among recording apparatuses or recording heads, characteristics of ink, usage conditions, or environmental influences. For example, when an image is recorded by reciprocating scanning of a recording head, the change in ejection velocity of ink droplets changes a relationship between a landing position of an ink droplet ejected in a forward path direction and a landing position of an ink droplet ejected in a return path direction, which influences image quality.

Japanese Patent Application Laid-Open No. 2007-152853 discusses a configuration including an optical detector that measures an ejection velocity of ink, and a registration adjusting method for appropriately setting an ejection timing from a moving velocity of a recording head and the ejection velocity based on a result of the measurement. Japanese Patent Application Laid-Open No. 2007-152853 also discusses, as a measurement method for an ink ejection velocity, a technique of measuring a time from a timing at which ink is ejected until a timing at which the ink reaches a light flux emitted from the optical detector, and calculating the ejection velocity based on a result of the measurement and a distance from the record head to the light flux.

According to the technique discussed in Japanese Patent Application Laid-Open No. 2007-152853, however, there is a possibility that increasing the number of measurements so as to decrease a measurement error increases a measurement error instead. Consecutively ejecting ink droplets to increase the number of measurements increases an amount of mist separated from main droplets of ink in the surroundings of a measurement environment as illustrated in FIG. 7B. Ejecting ink droplets in a state of an increased amount of mist in the surrounding environment promotes separation of the ink droplets into main and satellite droplets, and thereby the main droplets tend to be small in size. Further, there is a case where consecutive ejection inhibits refilling in time, and the main drops of ejected ink become small in size. There is a possibility that such small main droplets decreases an ejection velocity, and thus causes variations in measurement results.

SUMMARY

The present disclosure is directed to a technique of increasing accuracy in measuring droplets ejected from an ejection apparatus.

According to an aspect of the present disclosure, an ejection apparatus includes an ejection head that includes an ejection port configured to eject a droplet, a droplet detection unit configured to detect that the ejected droplet has reached a predetermined position, an acquisition unit configured to acquire information regarding a velocity of movement of the droplet detected by the droplet detection unit, a control unit configured to control the ejection head to eject the droplet from the ejection port, and a decision unit configured to decide a number of consecutive ejections of a plurality of droplets from the ejection head based on the information acquired by the acquisition unit regarding the velocities of each of the plurality of droplets ejected consecutively by the ejection head and detected by the droplet detection unit, and wherein, in a case where the acquisition unit acquires the information regarding velocities of droplets detected by the droplet detection unit, the control unit controls the ejection head to consecutively eject the droplets from the ejection head based on the decided number of consecutive ejections.

Further features of the present disclosure will become apparent from the following description of exemplary embodiments with reference to the attached drawings.

DESCRIPTION OF THE EMBODIMENTS

<Overview of Entire Recording Apparatus>

Figure 1:
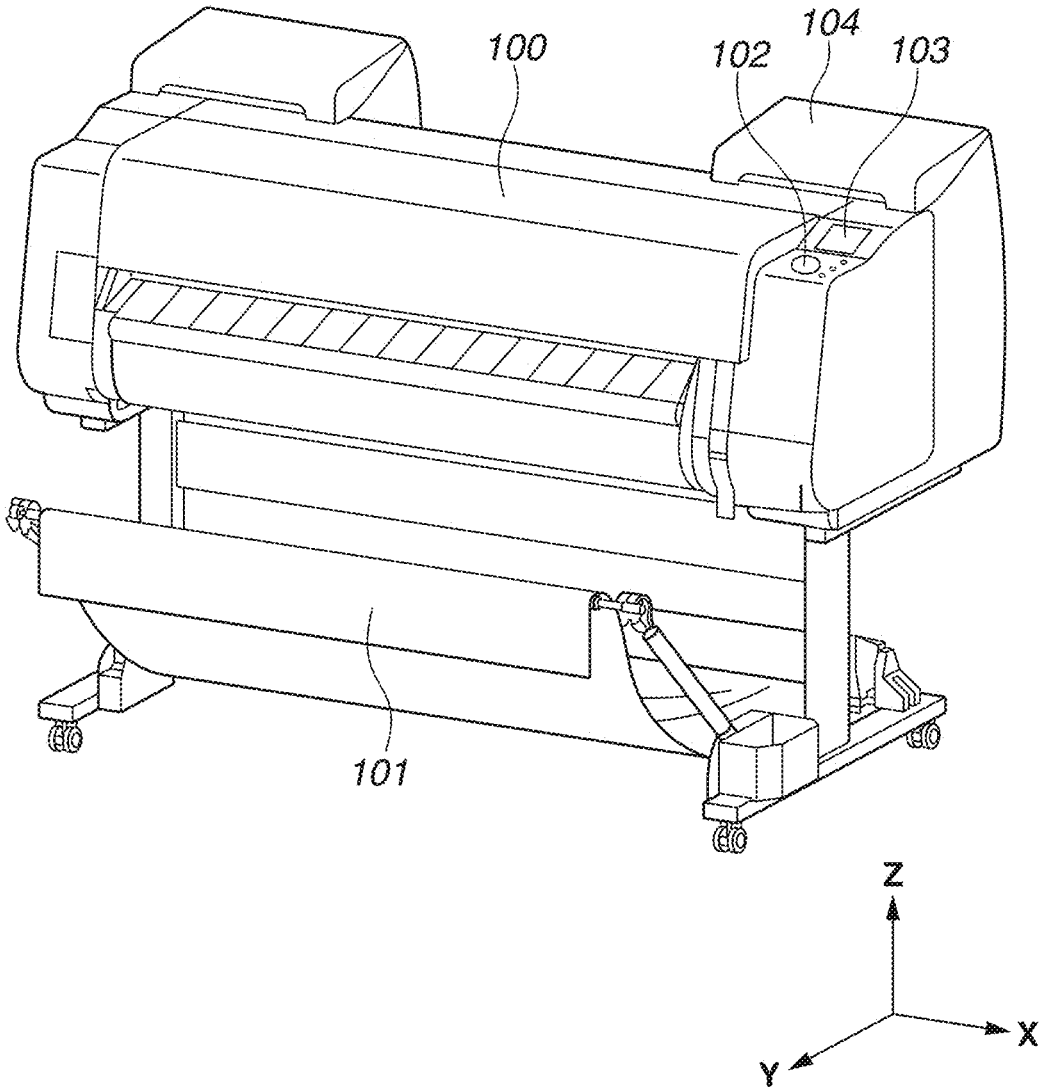
FIG. 1 is an external view of a recording apparatus according to a first exemplary embodiment.

FIG. 1 is an external view of an inkjet recording apparatus (hereinafter referred to as a recording apparatus) 100 as one example of a droplet ejection apparatus according to a first exemplary embodiment.

The recording apparatus 100 illustrated in FIG. 1 includes a sheet-discharge guide 101, a display panel 103, and an operation button 102. Output recording media are stacked on the sheet-discharge guide 101. The display panel 103 is used for displaying, for example, various kinds of recording information, and setting results. The operation button 102 is used for setting, for example, a recording mode, and recording paper. The recording apparatus 100 further includes an ink tank unit 104 that houses an ink tank containing ink in black, cyan, magenta, yellow, or the like, and that supplies ink to a recording head 201 (illustrated in FIG. 2) as one example of a droplet ejection head. The recording apparatus illustrated in FIG. 1 is capable of performing recording on recording media having a plurality of widths up to a 60 inch-size. Roll paper, cut paper, and the like can be used as the recording medium. In addition, the recording medium is not limited to paper, and may be a cloth or a sheet of vinyl.

Figure 2:
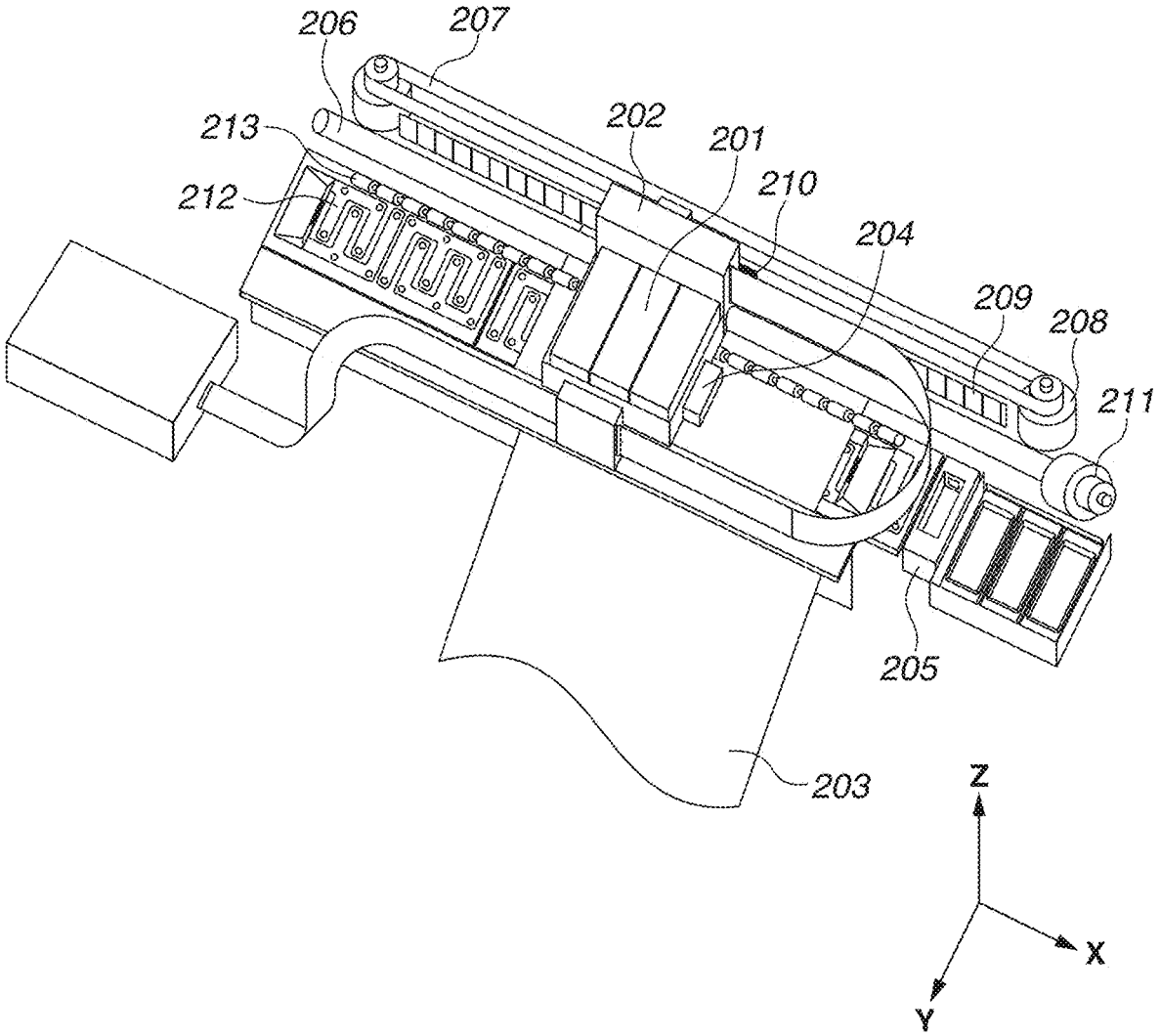
FIG. 2 is a perspective view illustrating an internal configuration of the recording apparatus according to the first exemplary embodiment.
Figure 4:
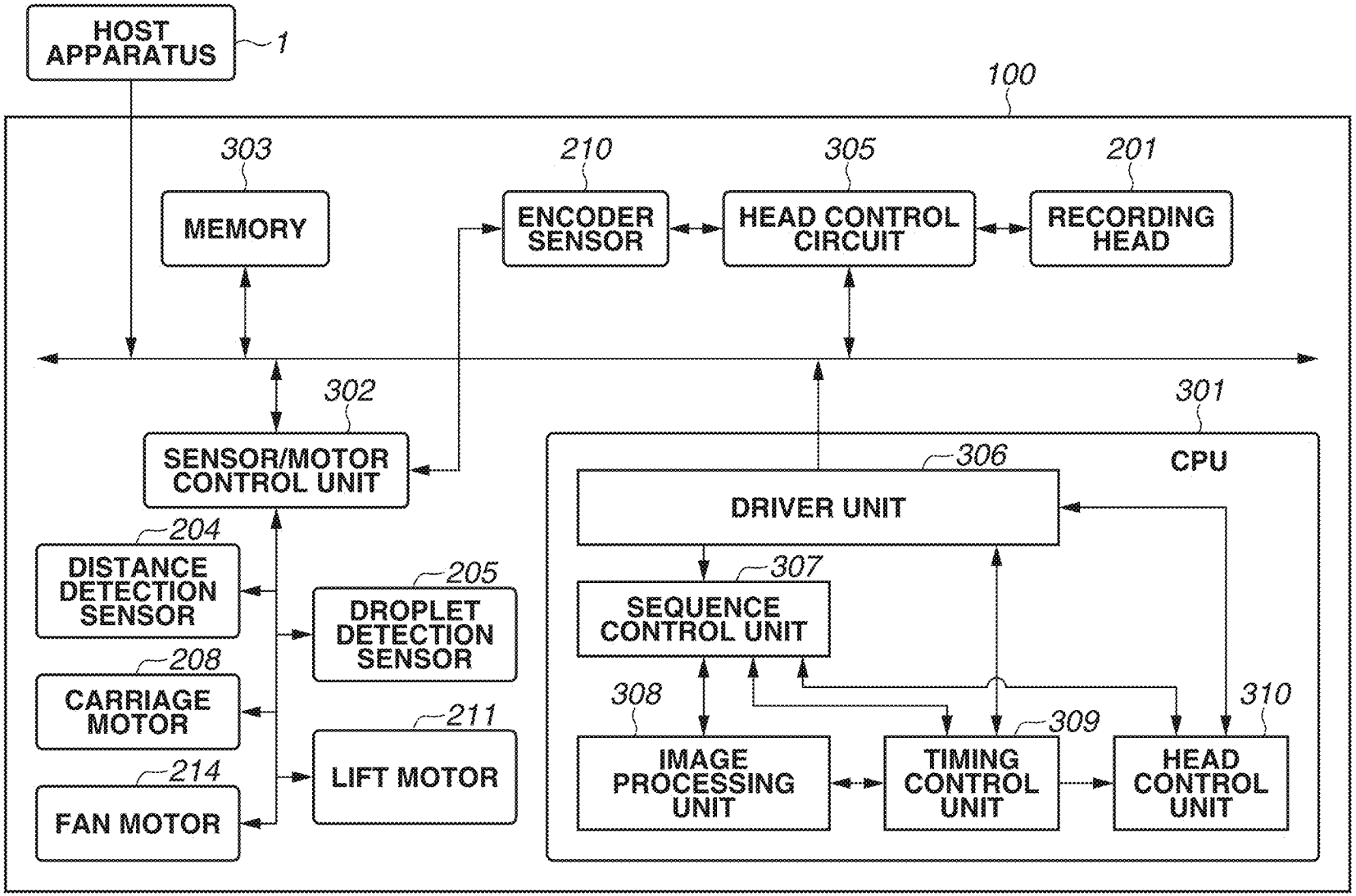
FIG. 4 is a block diagram illustrating a control configuration of the recording apparatus according to the first exemplary embodiment.
Figure 5A:
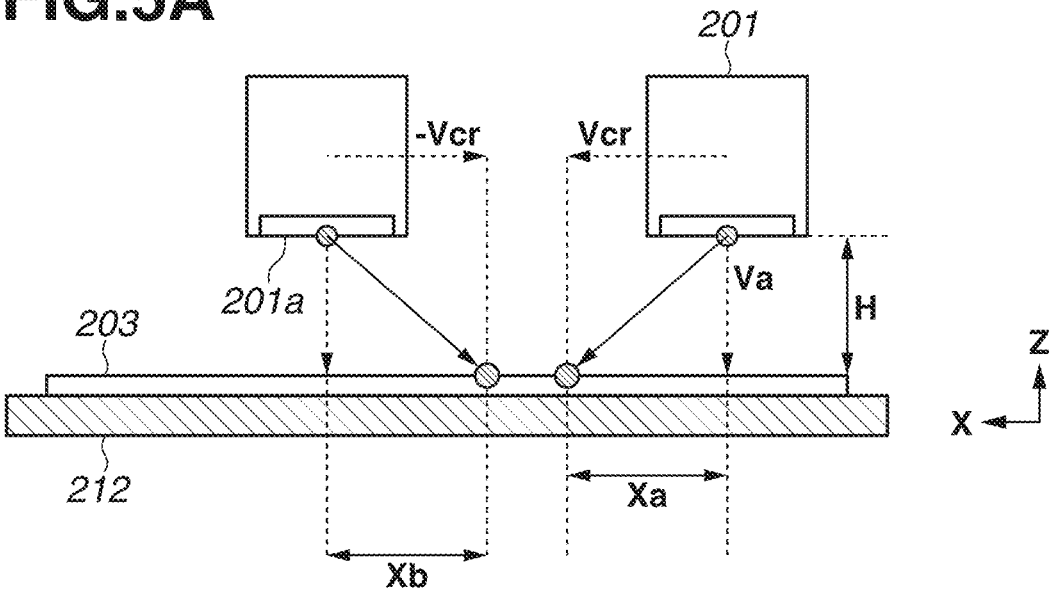
FIGS. 5A and 5B are schematic diagrams each illustrating a correlation between an ejection velocity of an ink droplet and a landing position of the ink droplet.

FIG. 2 is a perspective view illustrating an internal configuration of the recording apparatus 100. A platen 212 is a member that supports a recording medium 203 arranged at a position facing the recording head 201. The recording medium 203 is conveyed by a sheet-conveying roller 213 in a conveying direction (Y-direction) while being supported by the platen 212. The recording head 201 includes an ejection port surface 201*a* (FIGS. 5A and 5B) on which an ejection port is formed. An ejection port array in which a plurality of ejection ports is arrayed in the Y-direction is formed for each ink color on the ejection port surface 201*a*. Ejection port arrays are arrayed in an X-direction. The recording head 201 is mounted on a carriage 202. The recording head 201 includes a distance detection sensor 204 for detecting a distance between the recording medium 203 on the platen 212 and the recording head 201. The distance detection sensor 204, which is an optical sensor, includes a light-emitting element (FIG. 3A) that emits light onto the recording medium 203, and a light-receiving element (FIG. 3A) that receives light reflected from the recording medium 203. The distance detection sensor 204 measures a distance from the output fluctuation of an amount of light received by the light-receiving element. Details of the measurement will be described with reference to FIGS. 3A and 3B. A droplet detection sensor 205 is a sensor that detects droplets, ink droplets in this case, ejected from the recording head 201. The droplet detection sensor 205 is an optical sensor that includes a light-emitting element 401 (FIG. 6), a light-receiving element 402 (FIG. 6), and a control circuit substrate 403 (FIG. 6). Details of these elements will be described with reference to FIG. 6. A main rail 206 supports the carriage 202, and the carriage 202 performs reciprocating scanning along the main rail 206 in the X-direction (a direction orthogonal to the conveying direction of the recording medium). The carriage 202 performs scanning by being driven by a carriage motor 208 via a carriage conveying belt 207. A linear scale 209 is arranged in a scanning direction. An encoder sensor 210 mounted on the carriage 202 reads the linear scale 209 to acquire positional information. The recording apparatus 100 includes a lift cam (not illustrated) and a lift motor 211. The lift cam makes a height of the main rail 206, which supports the carriage 202, variable in a stepwise manner, and the lift motor 211 drives the lift cam. Driving the lift cam with the lift motor 211 allows the lift cam to elevate/lower the recording head 201 and decrease/increase a distance between the recording head 201 and the recording medium 203. The lift motor 211 can make the height of the main rail 206 variable with predetermined accuracy in a plurality of steps based on a stop position of the lift cam, and drives the lift cam such that a variable amount of the height is relative to a height in a predetermined step. It is thus possible to set a varying distance between steps with high accuracy. Below the platen 212, a mist fan (not illustrated) is arranged. The mist fan generates air currents for collecting mist that is separated from main ink droplets ejected from the recording head 201 and is floating between the recording head 201 and the platen 212. The mist fan is driven by a fan motor 214 (FIG. 4). The mist fan is driven at the time of a recording operation for recording an image on a recording medium, and then the mist fan collects mist. An installation position of the mist fan is not limited thereto. The installation position is only required to be a position at which the mist fan is moved to such a location as to prevent mist from influencing recording.

Figure 3A:
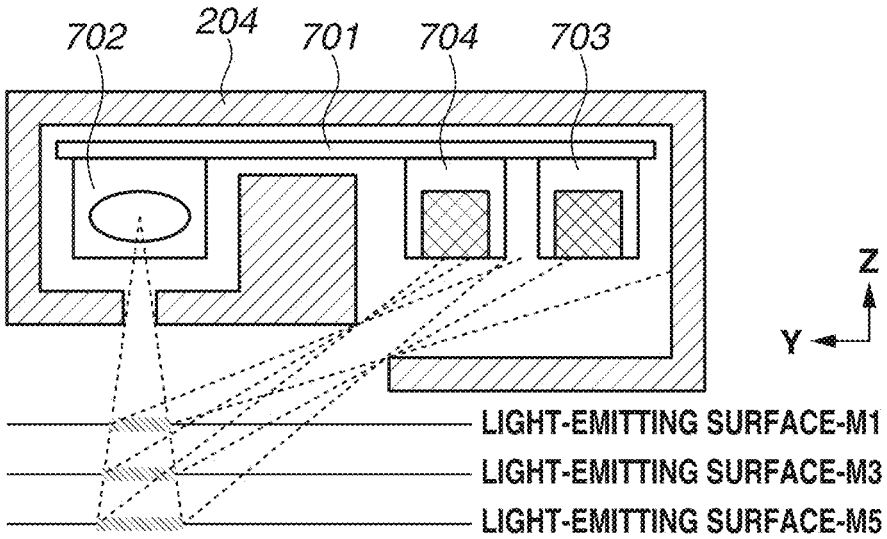
FIG. 3A is a diagram illustrating an internal configuration of a distance detection sensor according to the first exemplary embodiment.
Figure 3B:
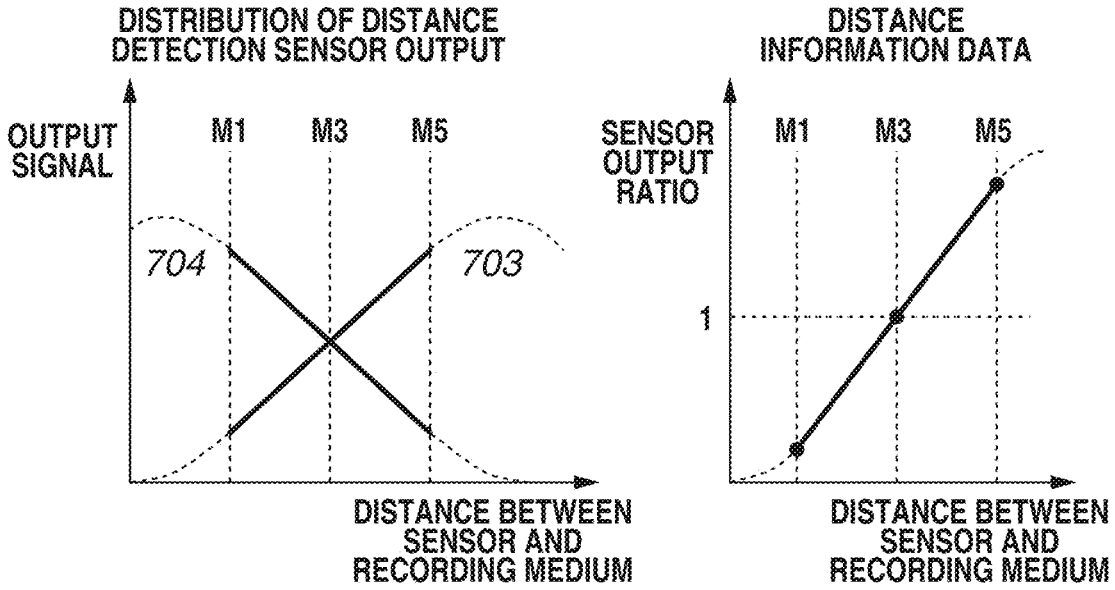
FIG. 3B is a diagram illustrating an example of detection according to the first exemplary embodiment.

FIG. 3A is a diagram illustrating an internal configuration of the distance detection sensor 204. FIG. 3B is a diagram illustrating a change of a light amount (output) in accordance with a distance to an irradiation surface of the recording medium 203 in each of an irradiation region and a light-receiving region. As illustrated in FIG. 3A, the distance detection sensor 204 incorporates a control substrate 701, a light-emitting unit 702, and light-receiving units 703 and 704. The control substrate executes processing of turning ON a light source to emit light toward a position to which the recording medium 203 is conveyed and processing of turning OFF the light source. The light-emitting unit 702 emits the light. The light-receiving units 703 and 704 receive the light reflected from the recording medium 203. In the present exemplary embodiment, a surface of the distance detection sensor 204 facing the recording medium 203 is at an identical position in a Z-direction to that of the ejection port surface 201*a* of the recording head 201. The distance to the recording medium 203 measured by the distance detection sensor 204 therefore corresponds to a distance between the ejection port surface 201*a* of the recording head 201 and the recording medium 203. The distance detection sensor 204 also converts intensities of the reflected light acquired in the light-receiving units 703 and 704 to output signals indicating current values or voltage values, executes predetermined computation processing on the output signals, and stores a result of the computation in a memory 303. For example, the distance detection sensor 204 stores distance information data indicating a relationship between a ratio value between the output signals obtained in the light-receiving units 703 and 704 and the distance from the recording head 201 to the recording medium 203. FIG. 3B illustrates a relationship between the output signals and the distance information data. As illustrated in FIG. 3B, when the distance to the irradiation surface of the recording medium 203 is M1, an amount of reflected light received by the light-receiving unit 704 reaches maximum and an amount of reflected light received by the light-receiving unit 703 reaches minimum. Hence, the ratio value between the output signals from the distance detection sensor 204, i.e., the distance information data, also indicates a minimum value. When the distance to the irradiation surface of the recording medium 203 is M3, respective amounts of reflected light received by the light-receiving units 703 and 704 become approximately half of the corresponding amounts at the peak. As distribution of output from the distance detection sensor, a signal value of the light-receiving unit 703 and that of the light-receiving unit 704 become equal to each other, and thereby the ratio value between the output signals from the distance detection sensor 204, i.e., the distance information data also indicates a value of 1. When the distance to the irradiation surface of the recording medium 203 is M5, an amount of reflected light received by the light-receiving unit 704 reaches minimum and an amount of reflected light received by the light-receiving unit 703 reaches maximum. As distribution of output from the distance detection sensor 204, a signal value of the light-receiving unit 704 indicates a minimum value, and a signal value of the light-receiving unit 703 indicates a maximum value, so that the ratio value between the output signals from the distance detection sensor 204, i.e., the distance information data also indicates a maximum value. Here, the present exemplary embodiment may preliminarily seek a relationship between the position of the irradiation surface serving as a criterion and a proportional value of an output signal from the distance detection sensor 204, and store the relationship in the memory 303. For example, a value detected with respect to a recording medium having a predetermined thickness may be held as a criterion value. Furthermore, the position of the recording head 201 when the distance from the recording head 201 to the recording medium 203 is any of M1 to M5 and the distance from the recording head 201 to the droplet detection sensor 205 at this time can also be stored.

<Block Diagram>

FIG. 4 is a block diagram illustrating a control configuration of the recording apparatus 100. The recording apparatus 100 includes a central processing unit (CPU) 301, a sensor/motor control unit 302, and the memory 303. The CPU 301 controls the entire recording apparatus 100. The sensor/motor control unit 302 controls each sensor and each motor. The memory 303 stores therein various kinds of information, such as an ejection velocity and a thickness of a recording medium. The CPU 301, the sensor/motor control unit 302, and the memory 303 are connected to be capable of communicating with one another. The sensor/motor control unit 302 controls the distance detection sensor 204, the droplet detection sensor 205, the carriage motor 208 that causes the carriage 202 to perform scanning, and the fan motor 214 for driving the mist fan. The sensor/motor control unit 302 controls a head control circuit 305 based on positional information detected by the encoder sensor 210 to eject ink from the recording head 201.

Image data transmitted from a host apparatus 1 is converted to an ejection signal by the CPU 301, and ink is ejected from the recording head 201 in accordance with the ejection signal. Print on the recording medium 203 is thus performed. The CPU 301 includes a driver unit 306, a sequence control unit 307, an image processing unit 308, a timing control unit 309, and a head control unit 310. The sequence control unit 307 performs the overall control of recording. Specifically, the sequence control unit 307, for example, starts and stops the image processing unit 308, the timing control unit 309, the head control unit 310, each serving as a functional block, controls conveyance of a recording medium, and controls scanning by the carriage 202. Control of each functional block is implemented by the sequence control unit 307 reading out various kinds of programs from the memory 303 and executing the programs. The driver unit 306 generates control signals for, for example, the sensor/motor control unit 302, the memory 303, and the head control circuit 305 based on a command from the sequence control unit 307, and transmits input signals from each block to the sequence control unit 307.

The image processing unit 308 executes image processing of subjecting image data input from the host apparatus 1 to color separation and conversion, and converting the input image data to recording data that can be recorded by the recording head 201. The timing control unit 309 transfers the recording data converted and generated by the image processing unit 308 to the head control unit 310 in conjunction with the position of the carriage 202. In addition, the timing control unit 309 also performs timing control of ejecting the recording data. The timing control unit 309 performs timing control in accordance with an ejection timing decided based on an ejection velocity calculated in ejection velocity calculation processing described below. The head control unit 310 functions as an ejection signal generating unit, and converts the recording data input from the timing control unit 309 to an ejection signal to output the ejection signal. The head control unit 310 also outputs a control signal at such a level as not to eject ink based on a command from the sequence control unit 307 to perform temperature control of the recording head 201. The head control circuit 305 functions as a driving pulse generating unit, generates a driving pulse in accordance with the ejection signal input from the head control unit 310, and applies the driving pulse to the recording head 201.

<Ejection Timing Adjustment>

A description will now be given of an ejection timing with reference to FIGS. 5A and 5B. FIG. 5A illustrates a relationship between an ejection velocity of an ink droplet and a landing position of the ink droplet. Assume that a distance H is a distance between the ejection port surface 201*a* of the recording head 201 and the recording medium 203 in the Z-direction. The recording head 201 ejects ink while performing reciprocating scanning at a velocity Vcr in the X-direction to record an image in the recording medium 203. Assume that an ejection velocity Va is a velocity of ejecting an ink droplet from the recording head 201. Since a scanning direction is different between scanning in the forward path direction and scanning in the return path direction, a landing position of an ink droplet with respect to an ejection position of the ink droplet is different between the scanning in the forward path direction and the scanning in the return path direction as illustrated in FIG. 5A. Ejection timings of ink droplets are adjusted to align the landing positions of the ink droplets ejected from the recording head 201. First, a distance Xa from the ejection position of an ink droplet to the landing position of the ink droplet on the recording medium 203 in the scanning in the forward path direction is calculated by the following formula.

$$Xa=(H/Va)\times Vcr$$

Furthermore, a distance Xb from the ejection position of an ink droplet to the landing position of the ink droplet on the recording medium 203 in the scanning in the return path direction is calculated by the following formula.

$$Xb=(H/Va)\times(-Vcr)=-Xa$$

With these formulas, an appropriate ejection timing with respect to the position of the recording head 201 detected by the encoder sensor 210 can be sought based on the distance from the recording head 201 to the recording medium 203 and the ejection velocity of an ink droplet detected by the droplet detection sensor 205. In the present exemplary embodiment, a default ejection velocity and an ejection timing with respect to the default ejection velocity are predetermined and stored in the memory 303. An adjustment value is adjusted to be a value from −4 to +4 in accordance with an ejection velocity with an adjustment value of the ejection timing with respect to this default ejection velocity being 0. The adjustment is performed in units of 1200 dots per inch (dpi). A table, in which this ejection velocity and the adjustment value of the ejection timing are brought into correspondence with each other, is preliminarily stored in the memory 303. The present exemplary embodiment acquires the adjustment value of the ejection timing in accordance with the ejection velocity acquired by the ejection velocity calculation processing, which will be described below with reference to FIG. 11, and adjusts the ejection timing.

Figure 5B:
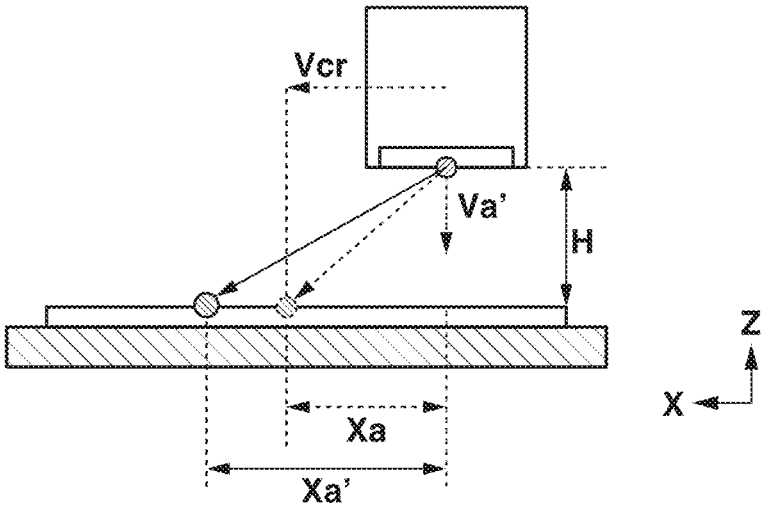
Figure 6:
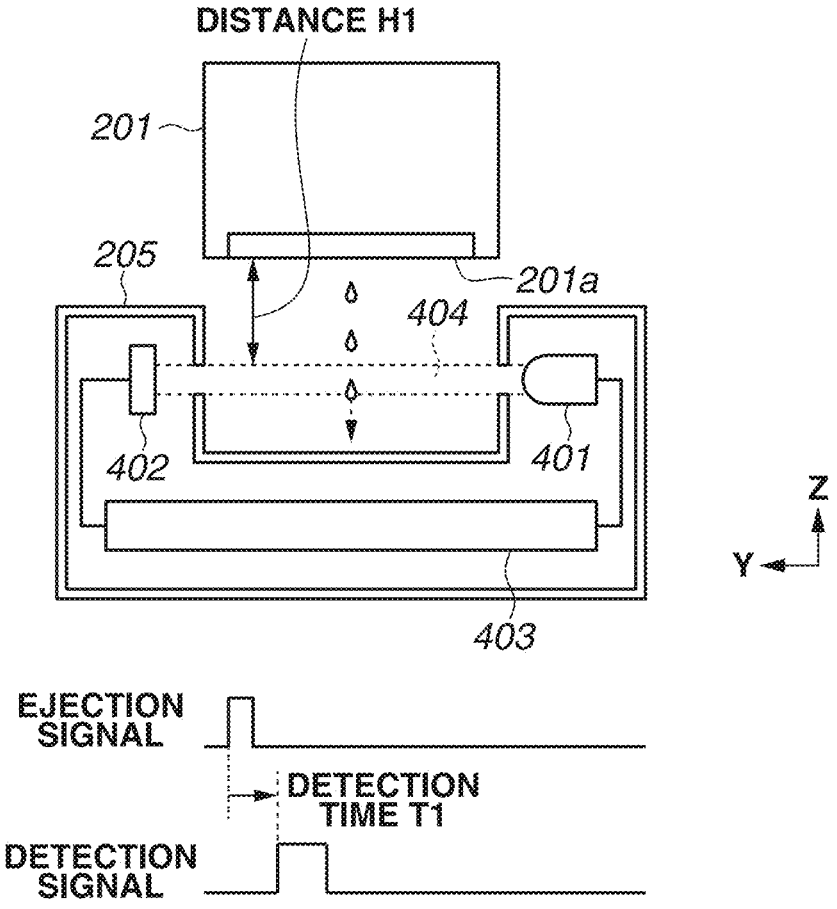
FIG. 6 is a diagram for explaining a method of calculating an ejection velocity of an ink droplet according to the first exemplary embodiment.

FIG. 5B illustrates a case where the ejection velocity of an ink droplet detected by the droplet detection sensor 205 decreases from the ejection velocity of an ink droplet illustrated in FIG. 5A. At this time, a distance Xa' from the ejection position of an ink droplet in the scanning in the forward path direction to the landing position of the ink droplet on the recording medium 203 is calculated by the following formula.

$$Xa'=(H/Va')\times Vcr$$

If the ejection velocity of the ink droplet ejected from the recording head 201 and landing on the recording medium 203 is attenuated by 10%, a distance from the ejection position to the landing position can be sought by the following formula.

$$Xa'=(H/Va')\times Vcr=(H/(Va\times 0.9))\times Vcr=1.11\times Xa$$

In this manner, the landing position is shifted in the scanning direction of the recording head 201 when the ejection velocity becomes lower. When the distance from the ejection position to the landing position is obtained, an appropriate adjustment value of the ejection timing can be sought based on the ejection velocity similarly to FIG. 5A. The first exemplary embodiment is on the assumption that the recording medium 203 is sufficiently thin, and the distance between the ejection port surface 201*a* of the recording head 201 and the recording medium 203 can be equated with a distance between the ejection port surface 201*a* and the platen 212.

<Ejection Velocity Calculation>

A description will be given of a method of calculating an ejection velocity of an ink droplet ejected from the recording head 201 according to the present exemplary embodiment with reference to FIG. 6. FIG. 6 is a schematic diagram illustrating the recording head 201 and the droplet detection sensor 205 when the recording apparatus 100 is cut along a Y-Z cross section. FIG. 6 also illustrates a timing chart of an ejection signal for applying a driving pulse to the recording head 201 and a detection signal when the droplet detection sensor 205 detects passage of an ink droplet.

As illustrated in FIG. 6, the recording head 201 includes the ejection port surface 201*a*. The droplet detection sensor 205 is composed of, for example, the light-emitting element 401, the light-receiving element 402, and the control circuit substrate 403. The light-emitting element 401 emits light 404, and the light-receiving element 402 receives the light 404 emitted from the light-emitting element 401. The control circuit substrate 403 detects an amount of light received by the light-receiving element 402. Since an amount of received light decreases when an ink droplet passes the light 404, the control circuit substrate 403 can detect the passage of the ink droplet. The droplet detection sensor 205 is installed at a position where the optical axis of the light 404 is at an identical position in the Z-direction to the position of a surface of the platen 212 on which the recording medium 203 is supported. A slit, which is arranged in proximity to each of the light-emitting element 401 and the light-receiving element 402, focuses the light 404 incident thereon and increases a signal-to-noise (S/N) ratio. Assume that a positional relationship in the X-direction between the droplet detection sensor 205 and the recording head 201 is a positional relationship for detection. In the droplet detection sensor 205, an ink droplet ejected from the recording head 201 passes through the light 404 emitted from the droplet detection sensor 205. When the droplet detection sensor 205 detects an ink droplet to calculate an ejection velocity of the ink droplet, the sequence control unit 307 causes the sensor/motor control unit 302 to control the carriage motor 208, and the recording head 201 moves to a detectable position. According to the present exemplary embodiment, a cross-section area of a light flux of the light 404 is approximately 1 $mm^2$. An area of parallel light projection of an ink droplet when the ink droplet passes through the light 404 is approximately $2^{-3}$ $mm^2$.

FIG. 6 illustrates a state when a distance between the ejection port surface 201*a* of the recording head 201 and the light 404 emitted from the light-emitting element 401 in a height direction (Z-direction) is a distance H1. In a case where the distance between the ejection port surface 201*a* and the light 404 is not the distance H1, the sensor/motor control unit 302 drives the lift motor 211 to cause the lift cam to change the height of the recording head 201. In the state illustrated in FIG. 6, the head control unit 310 in the CPU 301 transmits the ejection signal to the head control circuit 305 via the driver unit 306. The driver unit 306 transmits a transmission timing of the ejection signal to the sequence control unit 307. The head control circuit 305 generates a driving pulse in accordance with the ejection signal, and applies the driving pulse to the recording head 201 to eject ink from the ejection port. When an amount of received light received by the light-receiving element 402 is changed by the passage of an ink droplet through the light 404 emitted from the light-emitting element 401, the control circuit substrate 403 outputs a timing at which the amount of received light is changed as a detection signal. The output detection signal is transmitted to the sequence control unit 307 via the sensor/motor control unit 302. The sequence control unit 307 then detects a detection time T1 from the transmission of the ejection signal until the output of the detection signal, assuming that a timing of the transmission of the ejection signal from the driver unit 306 to the head control circuit 305 is an ejection start timing. As described above, the sequence control unit 307 functions as a time detection unit that detects a time from the start of ejection of an ink droplet until the detection of the ejected ink droplet, and detects a detection time for calculating an ejection velocity. In the present exemplary embodiment, the timing of the transmission of the ejection signal to the head control circuit 305 is assumed to be the ejection start timing. However, there may be a case where it takes long from input of the ejection signal to the head control circuit 305 until actual ejection of an ink droplet depending on a structure or the like of the recording head 201. In such a configuration, a time from a point of time when a predetermined time has elapsed from the timing of transmission of the ejection signal until a point of time when the detection signal is output can be assumed as the detection time.

When detecting the detection time T1, the sequence control unit 307 calculates an ejection velocity V from the detection time T1 and the distance H1 by the following formula.

$$V=H1/T1$$

In this manner, the ejection velocity can be calculated.

<Decision of Measurement Condition>

A description will now be given of decision of a measurement condition for a detection time. To calculate an ejection velocity, the present exemplary embodiment measures a detection time a plurality of times, a total of 1000 times in this case, and calculates an ejection velocity based on the measured detection times. When measuring the detection times, the present exemplary embodiment does not drive the mist fan to prevent ejected ink droplets from being influenced by air currents.

Figure 7B:
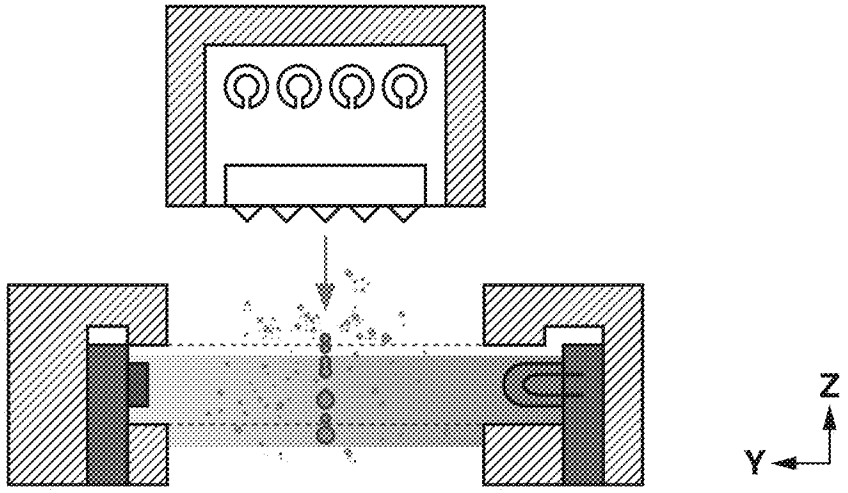
FIGS. 7A and 7B are schematic diagrams each illustrating a state of a measurement environment in the surroundings of a recording head and a droplet detection sensor at the time of measuring a detection time.
Figure 7A:
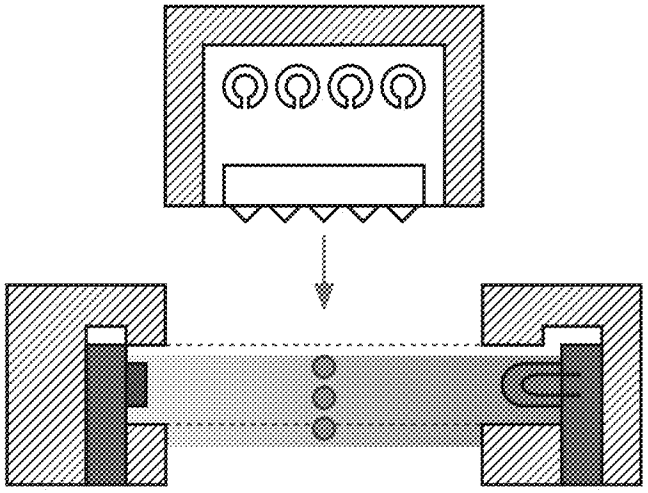

FIGS. 7A and 7B are schematic diagrams each illustrating a state of a measurement environment in the surroundings of the recording head 201 and the droplet detection sensor 205 at the time of measuring the detection times. FIG. 7A illustrates a case where there is only a small amount of mist suspended in the air in the measurement environment. FIG. 7B illustrates a state where there is a large amount of mist suspended in the air in the measurement environment. Immediately after the start of ejection of ink droplets for measurement, there is a small amount of mist suspended in the air as illustrated in FIG. 7A. However, with the increased number of ejections, the measurement environment becomes a state where there is a large amount of mist suspended in the air as illustrated in FIG. 7B. When ink is ejected in such an environment in which a large amount of mist is generated, ink droplets are easily separated into main and satellite droplets and an ejection velocity decreases, which elongates detection times. Even in the state where there is a small amount of mist suspended in the air, in a case where consecutive ejection inhibits refilling in time, ink droplets become small in size, which elongates detection times.

Figure 8A:
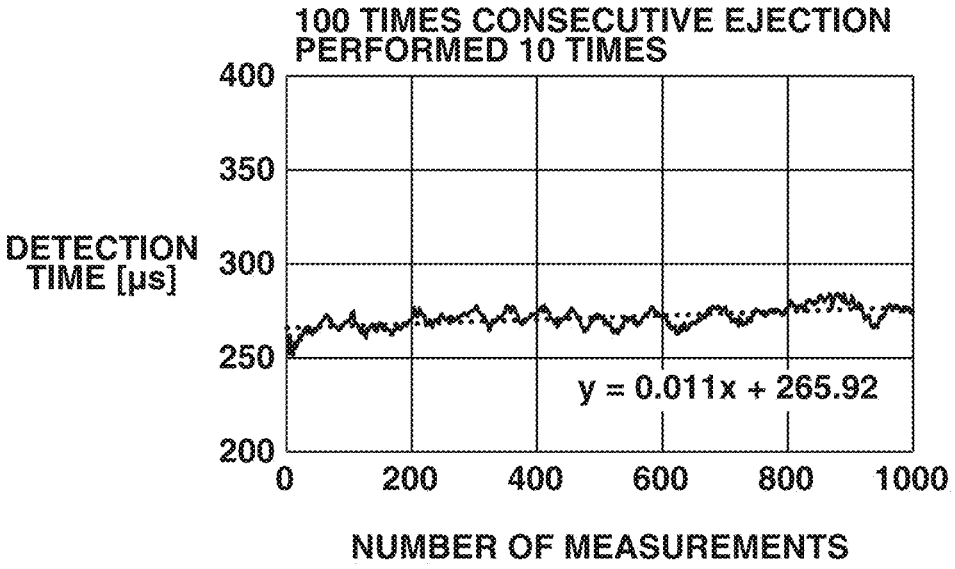
FIGS. 8A and 8B are graphs each indicating a relationship between a detection time and the number of measurements according to the first exemplary embodiment.
Figure 8B:
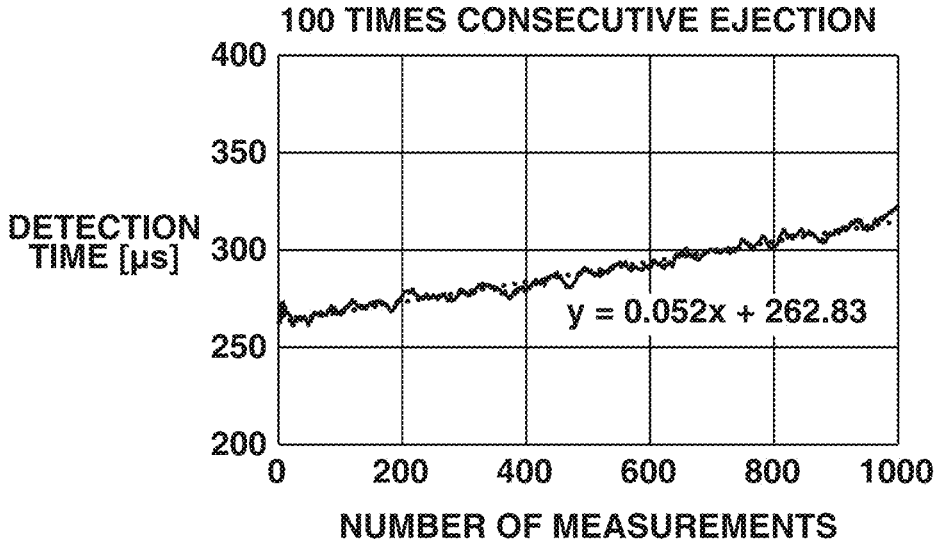

FIGS. 8A and 8B are graphs each indicating a relationship between a detection time and the number of measurements. FIG. 8A indicates detection times in a case of performing 1000 times consecutive ejections of ink. As illustrated in FIG. 8A, detection times become longer with the increased number of measurements. An increasing tendency of detection times is different depending on a composition of ink and characteristics of a recording head due to manufacturing irregularities.

Figure 9:
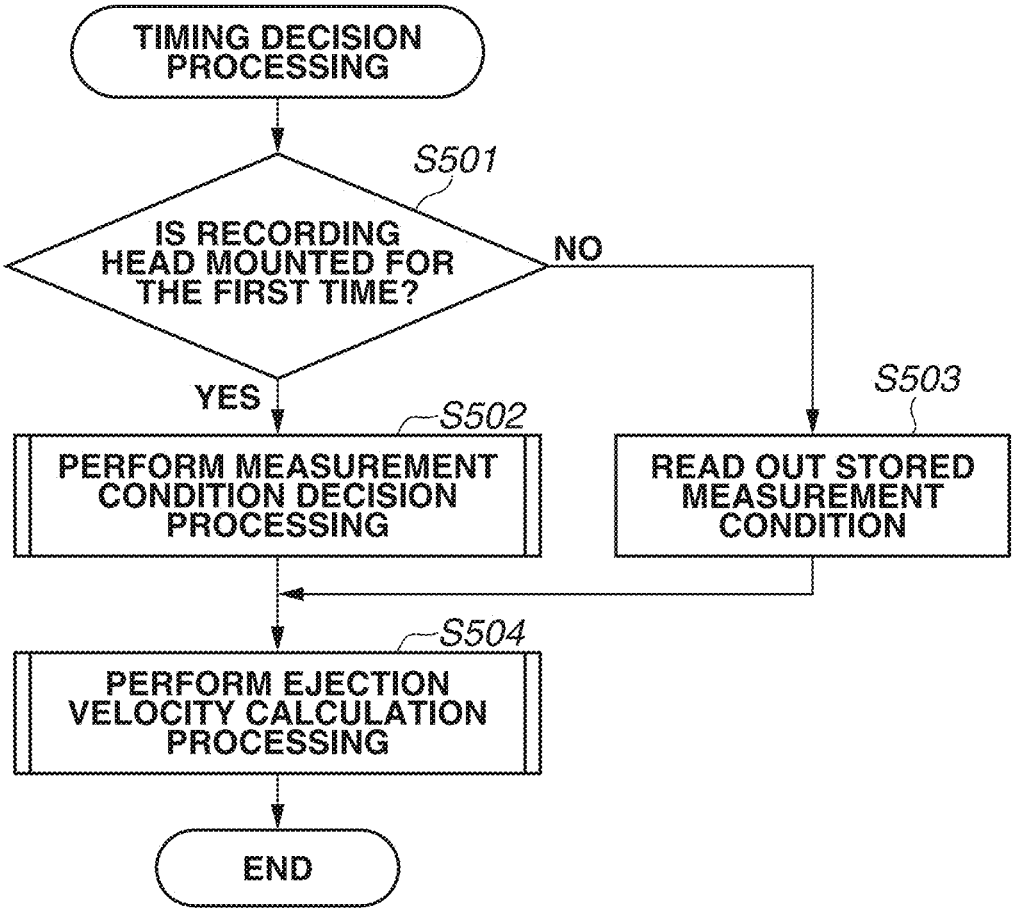
FIG. 9 is a flowchart for determining a timing to decide a measurement condition according to the first exemplary embodiment.

To address this issue, the present exemplary embodiment decides such a measurement condition as to enable stable detection of detection times. In this processing, the present exemplary embodiment decides the number of consecutive ejections of ink from an identical ejection port. In a period of measuring detection times with respect to a predetermined ejection port, the present exemplary embodiment does not measure detection times with respect to another ejection port. FIG. 9 illustrates a flowchart for determining a timing to decide a measurement condition. This processing is executed when the recording head 201 is mounted on the recording apparatus 100, and is executed by the sequence control unit 307 in the CPU 301 in accordance with a program stored in, for example, the memory 303.

In step S501, the sequence control unit 307 determines whether the mounted recording head 201 is mounted on the recording apparatus 100 for the first time. The sequence control unit 307 makes the determination by reading out data stored in a memory in the recording head 201. If the sequence control unit 307 determines that the recording head 201 is mounted on the recording apparatus 100 for the first time (YES in step S501), the processing proceeds to step S502. In step S502, the sequence control unit 307 executes measurement condition decision processing. In this processing, the sequence control unit 307 decides the number of consecutive ejections to be performed in the measurement of detection times. Details of the measurement condition decision processing will be described below with reference to FIG. 10. If the sequence control unit 307 determines that the recording head 201 is not mounted on the recording apparatus 100 for the first time (NO in step S501), the processing proceeds to step S503. In step S503, the sequence control unit 307 selects a measurement condition stored in the memory 303.

In step S504, the sequence control unit 307 executes the ejection velocity calculation processing. The sequence control unit 307 detects detection times used for calculating an ejection velocity based on the measurement condition decided in step S502 or step S503. Details of the ejection velocity calculation processing will be described with reference to FIG. 11.

Figure 10:
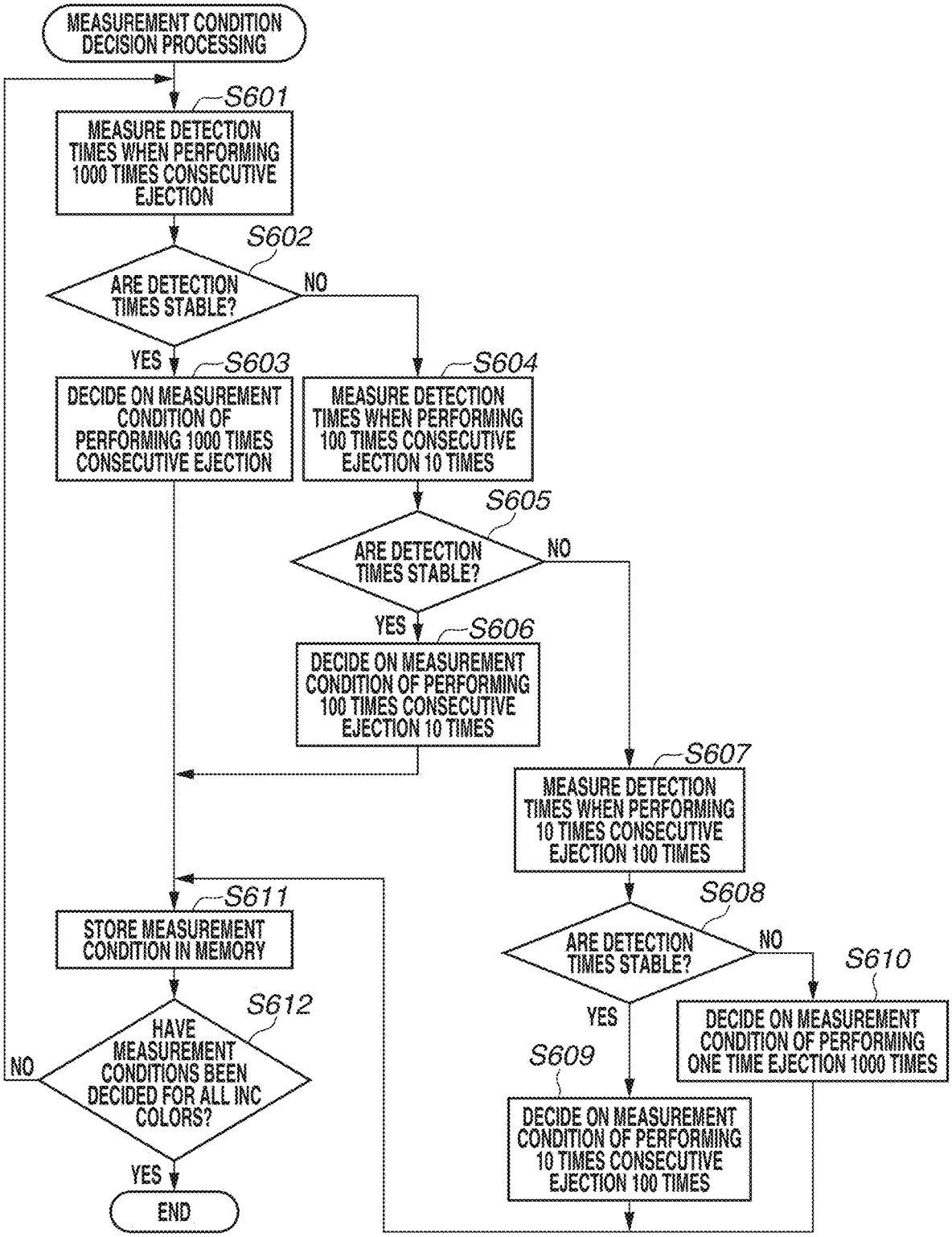
FIG. 10 is a flowchart of measurement condition decision processing according to the first exemplary embodiment.

FIG. 10 illustrates a flowchart of the measurement condition decision processing.

In step S601, the sequence control unit 307 measures detection times in a case of performing 1000 times consecutive ejections of ink droplets as a first measurement condition. The first to fourth measurement conditions to be used for this processing are preliminarily stored in the memory 303.

In step S602, the sequence control unit 307 determines whether the detection times measured in step S601 are stable. Determination whether the measured detection times are stable depends on variations in the measured detection times. For example, the sequence control unit 307 obtains a variance from measurement values, and determines that the measured detection times are stable if the obtained variance is equal or less than a predetermined value. Alternatively, the sequence control unit 307 may determine that the measured detection times are stable if a ratio of detection times that fall within ±5% from an average value of the measurement values is higher than or equal to 80%. Still alternatively, the sequence control unit 307 may derive an expression of approximate curve of time-series data of the measured detection times, and determine that the detection times are stable if a coefficient of the expression is less than or equal to a predetermined value. In addition, the present exemplary embodiment employ fixed values, instead of the ratio, to set a range. If the sequence control unit 307 determines that the detection times are stable (YES in step S602), the processing proceeds to step S603. If the sequence control unit 307 determines that the detection times are not stable (NO in step S602), the processing proceeds to step S604.

In a case where the processing proceeds to step S603, the sequence control unit 307 decides on a condition of measuring detection times by performing 1000 times consecutive ejections of ink droplets in the measurement. In step S611, the sequence control unit 307 then stores the measurement condition decided in step S603 in the memory 303.

After completion of the processing in step S611, the processing proceeds to step S612. In step S612, the sequence control unit 307 determines whether measurement conditions have been decided with respect to all of ink colors. If the sequence control unit 307 determines that the measurement conditions have been decided with respect to all of the ink colors (YES in step S612), the processing ends. If the sequence control unit 307 determines that the measurement conditions have not been decided with respect to all of the ink colors (NO in step S612), the processing returns to step S601. The sequence control unit 307 then executes the processing with respect to an ink color for which a measurement condition has not been decided.

In a case where the processing proceeds to step S604, the sequence control unit 307 repeats an operation of performing 100 times consecutive ejections and thereafter performing a wait operation ten times, which is a second measurement condition, and measures detection times in a case of performing 1000 times ejections.

In step S605, the sequence control unit 307 determines whether the detection times measured in step S604 are stable. Determination whether the measured detection times are stable depends on variations in the measured detection times in the case of performing 1000 times ejections. The variations can be calculated in a similar manner to step S602. A calculation method and a determination criterion are preferably identical to those used in step S602 in terms of evaluating whether improvement is seen in detection by changing the number of consecutive ejections, but may be changed as appropriate. If the sequence control unit 307 determines that the detection times are stable (YES in step S605), the processing proceeds to step S606. In step S606, the sequence control unit 307 decides on a measurement condition of measuring detection times by repeatedly performing 100 times consecutive ejections ten times. In step S611, the sequence control unit 307 stores the measurement condition decided in step S606 in the memory 303.

If the sequence control unit 307 determines that the detection times are not stable (NO in step S605), the processing proceeds to step S607. In step S607, the sequence control unit 307 repeats an operation of performing ten times consecutive ejections and thereafter performing a wait operation 100 times, which is a third measurement condition, and measures detection times in a case of performing 1000 times ejections.

In step S608, the sequence control unit 307 determines whether the detection times measured in step S607 are stable. Determination whether the measured detection times are stable depends on variations in the detection times in the 1000 times consecutive ejections, which is measured in step S607. The variations can be calculated in a similar manner to step S602. A calculation method and a determination criterion are preferably identical to those used in steps S602 and S604 in terms of evaluating whether improvement is seen in detection by changing the number of consecutive ejections, but may be changed as appropriate. The determination method is similar to that used in step S602. If the sequence control unit 307 determines that the detection times are stable (YES in step S608), the processing proceeds to step S609. In step S609, the sequence control unit 307 decides on a measurement condition of measuring detection times by repeatedly performing ten times consecutive ejections 100 times. In step S611, the sequence control unit 307 stores the measurement condition decided in step S609 in the memory 303.

If the sequence control unit 307 determines that the detection times are not stable (NO in step S608), the processing proceeds to step S610. In step S610, the sequence control unit 307 decides to measure detection times by inserting a wait operation every ejection and performing 1000 times ejections, which is a fourth measurement condition. In step S611, the sequence control unit 307 stores the measurement condition decided in step S610 in the memory 303.

As described above, the sequence control unit 307 decides on a measurement condition for detection times with respect to each of the ink colors. In a case where an identical condition can be set with respect to each of the ink colors, the sequence control unit 307 may decide on a measurement condition with respect to one ink color by executing the processing in FIG. 10, and decide on the measurement condition decided with respect to the one ink color also as a measurement condition with respect to the other ink colors. While the present exemplary embodiment sets a condition that enables measurement of detection times in a total of 1000 times ejections as each of the measurement conditions that can be decided, the second to fourth measurement conditions require insertion of a wait time, and thus it takes long to measure detection times. To reduce a measurement time, the present exemplary embodiment may set such a measurement condition as to decrease a total number of detections.

The present exemplary embodiment determines stability of detection times in FIG. 10, but may alternatively seek a measurement condition by also calculating an ejection velocity and determining stability of the ejection velocity.

In a period of measuring detection times with respect to the predetermined ejection port, the present exemplary embodiment does not measure detection times with respect to another ejection port. However, detection times with respect to the predetermined ejection port and another ejection port in an identical period may be measured. In a case where two ejection ports are arranged at such positions as being influenced by mist, the present exemplary embodiment may set a measurement condition in consideration of ejections from the two ejection ports.

<Ejection Velocity Calculation Processing>

Figure 11:
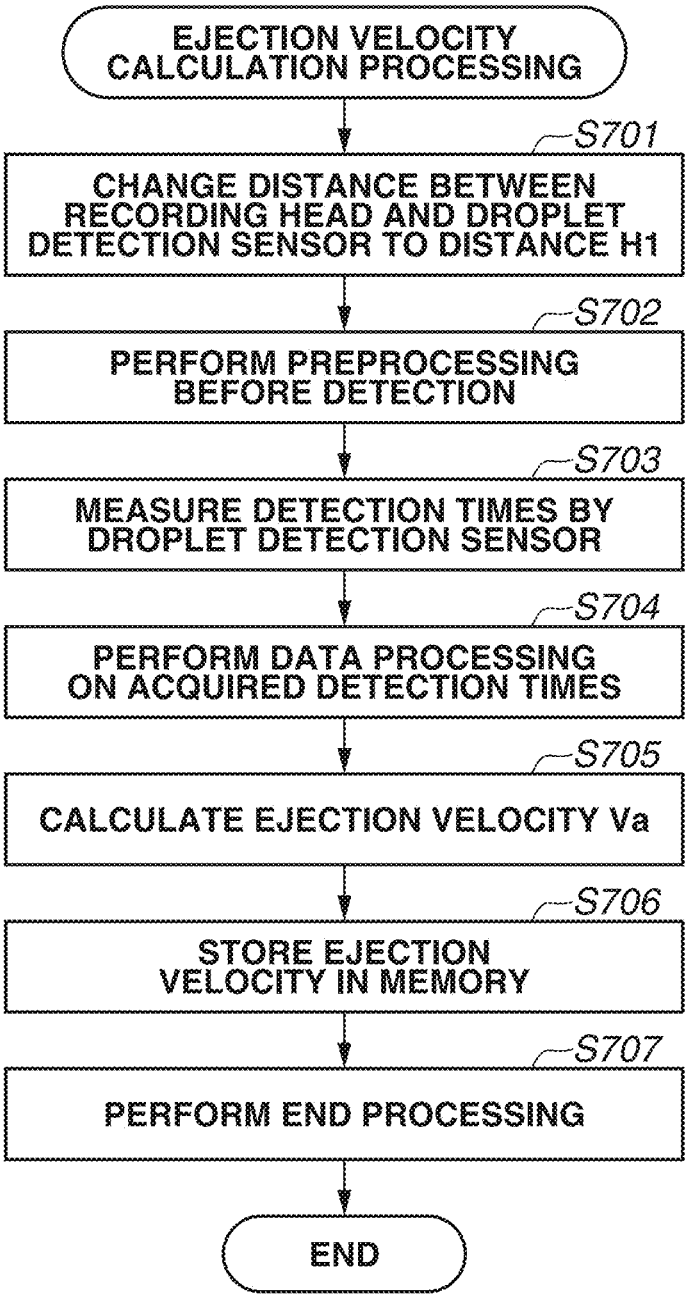
FIG. 11 is a flowchart of processing of ejection velocity calculation processing according to the first exemplary embodiment.

FIG. 11 is a flowchart of the ejection velocity calculation processing, which corresponds to the method of calculating an ejection velocity described with reference to FIG. 6 and the processing in step S504 illustrated in FIG. 9.

The ejection velocity calculation processing illustrated in FIG. 11 is processing executed when a user of the recording apparatus 100 performs an operation for initial installation to operate the recording apparatus 100 for the first time or when the recording head 201 is replaced with a new one and the new recording head 201 is mounted. Further, the ejection velocity calculation processing may be periodically executed as maintenance, or may be executed in accordance with the user's instruction. The processing in FIG. 11 is processing executed by the sequence control unit 307 in the CPU 301 in accordance with a program stored in, for example, the memory 303.

In step S701, the sequence control unit 307 first drives the lift motor 211, and separates the recording head 201 and the droplet detection sensor 205 from each other by a predetermined distance. The distance for separation is preliminarily set in the memory 303, and is distance H (H1) described with reference to FIGS. 5A and 5B in the present exemplary embodiment.

In step S702, the sequence control unit 307 executes preprocessing for detecting an ejection velocity. Specifically, examples of the preprocessing include preliminary setting of appropriate ejection control for detecting an ejection velocity, a preliminary ejection operation for stably ejecting ink droplets, and a mist fan stop operation for stabilizing control of air currents in the recording apparatus 100.

In step S703, the sequence control unit 307 executes an ejection operation of ejecting ink droplets for detection from the recording head 201 to the light 404 emitted from the light-emitting element 401 of the droplet detection sensor 205, in accordance with the condition decided in the measurement condition decision processing in FIG. 10. Specifically, the sequence control unit 307 detects, at the distance H1 for separation performed in step S701, a detection time from the start of ejection of an ink droplet from a predetermined nozzle of the recording head 201 until the passage of the ink droplet through the light 404 detected by the light-receiving element 402 of the droplet detection sensor 205. At this time, the sequence control unit 307 detects a plurality of detection times using a plurality of nozzles of the recording head 201. As the nozzles to be used for measuring the detection times, a wide range of nozzles including both ends and the center of the recording head 201 is preferably selected to accurately detect an ejection velocity.

In step S704, the sequence control unit 307 executes data processing on the detection times acquired in step S703, and calculates a detection time with respect to the distance for separation performed in step S701. Specifically, the sequence control unit 307 executes data processing including averaging processing based on the number of acquisition samples used for stabilizing measurement of detection times, and deletion of data outside an upper/lower error range to eliminate an abnormal value of data.

In step S705, the sequence control unit 307 executes calculation of an ejection velocity. Specifically, the sequence control unit 307 calculates the ejection velocity based on the detection time measured at the distance H1, as described with reference to FIG. 6. When the ejection velocity is calculated, the processing proceeds to step S706. In step S706, the sequence control unit 307 stores information of the ejection velocity calculated in step S705 in the memory 303. The ejection velocity information stored herein is used for data processing and drive-control of the recording head 201 as the need arises in processing.

In step S707, the sequence control unit 307 performs end processing. Specifically, since the calculation of the ejection velocity has been completed, the sequence control unit 307, for example, retracts the recording head 201 to a predetermined position, makes a transition to a standby state for executing the next recording operation processing, or furthermore, starts to execute cleaning processing of the recording head 201 based on the acquired ejection velocity information. Thereafter, the present processing ends.

When completing the ejection velocity calculation processing in FIG. 11, the sequence control unit 307 acquires a table preliminarily stored in the memory 303 in which an ejection velocity and an adjustment value of an ejection timing are in correspondence with each other, and acquires an adjustment value of an ejection timing from the table based on the ejection velocity acquired by the processing in FIG. 11. The ejection timing is then adjusted based on the acquired adjustment value. When performing print of an image, the timing control unit 309 performs control of the ejection timing of ink in accordance with recording data.

As described above, the present exemplary embodiment decides a measurement condition for measuring detection times for calculating an ejection velocity, and can thereby stably measure the detection times while suppressing the influence by a composition of ink and characteristics of a recording head due to manufacturing irregularities. This configuration can improve accuracy of calculating an ejection velocity. Further, if consecutive ejection is possible, the present exemplary embodiment performs measurement by consecutively ejecting ink, and can thereby perform measurement while preventing an increase in measurement time.

The present exemplary embodiment stops the mist fan while measuring detection times. However, the mist fan may be driven to collect mist during a wait operation under the measurement condition of inserting the wait operation during the measurement.

In a case where the detection times are stable at the time of 1000 times consecutive ejections as the first measurement condition, the present exemplary embodiment described above uses the first measurement condition as the measurement condition. Alternatively, the present exemplary embodiment may measure the detection times under all the measurement conditions and select a condition under which the detection times are the most stable.

While the present exemplary embodiment uses the optical sensor as a sensor that detects ink droplets, any sensor other than the optical sensor can also be used as long as the sensor is capable of detecting that an ink droplet reaches a predetermined position.

The first exemplary embodiment calculates an ejection velocity from detection times in the case where the distance from the ejection port surface of the recording head 201 to the droplet detection sensor 205 is the distance H1. A second exemplary embodiment measures detection times at a plurality of distances and calculates ejection velocities. A description of a part similar to that of the first exemplary embodiment will be omitted.

<Calculation of Ejection Velocity>

A description will be given of an ejection velocity of an ink droplet ejected from the recording head 201 according to the present exemplary embodiment with reference to FIGS. 12A to 12D. FIGS. 12A to 12D are schematic diagrams each illustrating the recording head 201 and the droplet detection sensor 205 when the recording apparatus 100 is cut along a Y-Z cross section. FIGS. 12A to 12D each illustrate a timing chart of an ejection signal for applying a driving pulse to the recording head 201 and a detection signal when the droplet detection sensor 205 detects the passage of an ink droplet.

Figure 12A:
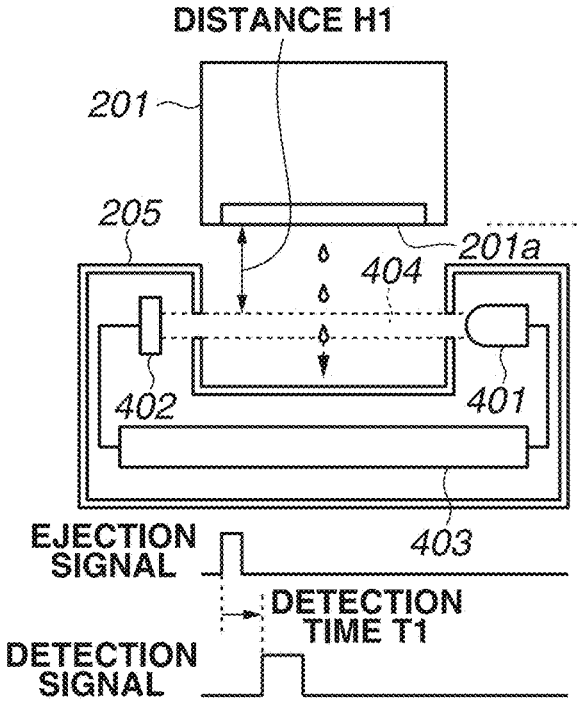
FIGS. 12A to 12D are diagrams each illustrating an internal configuration of a distance detection sensor and an example of detection according to a second exemplary embodiment.

FIG. 12A illustrates a state assuming that the distance in the height direction (Z-direction) between the ejection port surface 201*a* of the recording head 201 and the light 404 emitted from the light-emitting element 401 of the droplet detection sensor 205 is the distance H1. A detection time is detected in a method similar to that according to the first exemplary embodiment. In a case where the distance between the ejection port surface 201*a* and the light 404 is not the distance H1, the sensor/motor control unit 302 drives the lift motor 211 to cause the lift cam to change the height of the recording head 201. In the state illustrated in FIG. 12A, the head control unit 310 in the CPU 301 transmits an ejection signal to the head control circuit 305 via the driver unit 306. The driver unit 306 transmits a transmission timing of the ejection signal to the sequence control unit 307. The head control circuit 305 generates a driving pulse in accordance with the ejection signal, and applies the driving pulse to the recording head 201 to eject ink from the ejection port. When an amount of received light received by the light-receiving element 402 is changed by the passage of an ink droplet through the light 404 emitted from the light-emitting element 401, the control circuit substrate 403 outputs a timing at which the amount of received light is changed as a detection signal. The output detection signal is transmitted to the sequence control unit 307 via the sensor/motor control unit 302. The sequence control unit 307 then detects the detection time T1 from the transmission of the ejection signal until the output of the detection signal.

Figure 12B:
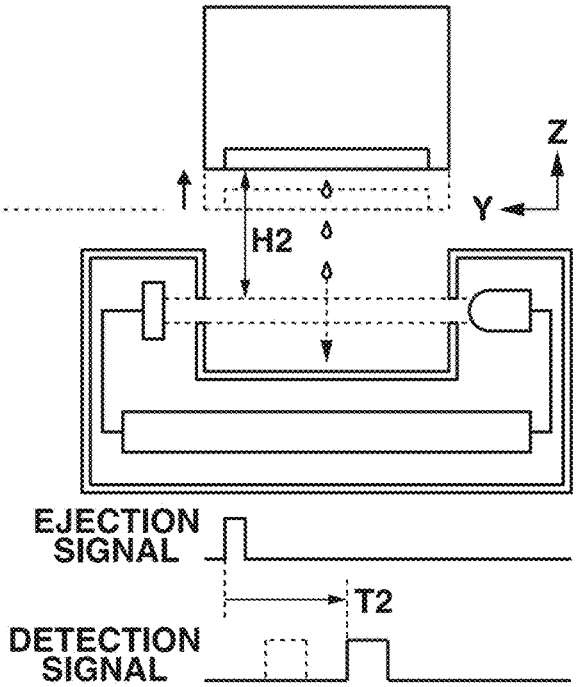

FIG. 12B illustrates a state at the time of driving the lift motor 211 after the ejection of an ink droplet as illustrated in FIG. 12A, and assuming that the distance in the height direction (Z-direction) between the ejection port surface 201*a* and the light 404 emitted from the light-emitting element 401 is a distance H2. Similarly to FIG. 12A, a timing at which an amount of light received by the light-receiving element 402 is changed when an ink droplet passes through the light 404 emitted from the droplet detection sensor 205 is output as a detection signal. The sequence control unit 307 then detects a detection time T2 from the transmission of the ejection signal for causing the recording head 201 to eject an ink droplet until the output of the detection signal.

In the present exemplary embodiment, when detecting the detection times T1 and T2 in the states illustrated in FIGS. 12A and 12B, respectively, the sequence control unit 307 calculates an ejection velocity V1 of an ink droplet, which passes between the ejection start point of the distance H2 and the ejection start point of the distance H1, based on a time difference between the detection time T1 and the detection time T2 and a distance difference between the distance H1 and the distance H2, by the following formula.

$$V1=(H2-H1)/(T2-T1)$$

Figure 12C:
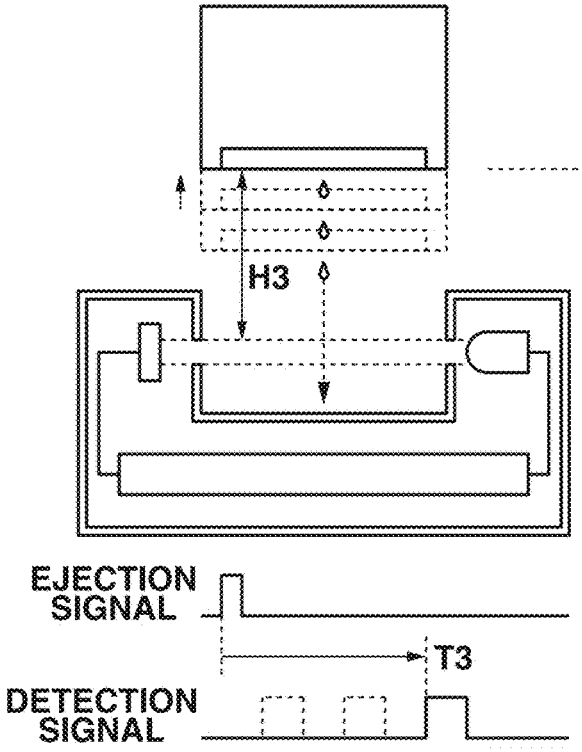

After calculating the ejection velocity V1, the sequence control unit 307 drives the lift motor 211 to change the distance in the height direction between the ejection port surface 201*a* and the light 404 to the distance H3, which is longer than the distance H2. FIG. 12C illustrates this state. Similarly to FIGS. 12A and 12B, the control circuit substrate 403 detects a timing at which an amount of light is changed when an ink droplet, which has been emitted from the ejection port of the recording head 201, passes through the light 404 emitted from the droplet detection sensor 205 as a timing detection signal. The sequence control unit 307 then detects a detection time T3 from the transmission of the ejection signal for causing the recording head 201 to eject an ink droplet until the output of the detection signal. Similarly to the cases described with reference to FIGS. 12A and 12B, the sequence control unit 307 calculates an ejection velocity V2 of an ink droplet, which passes between the ejection start point of the distance H3 and the ejection start point of the distance H2, based on a time difference between the detection time T2 and the detection time T3 and a distance difference between the distance H2 and the distance H3, by the following formula.

$$V2=(H3-H2)/(T3-T2)$$

Figure 12D:
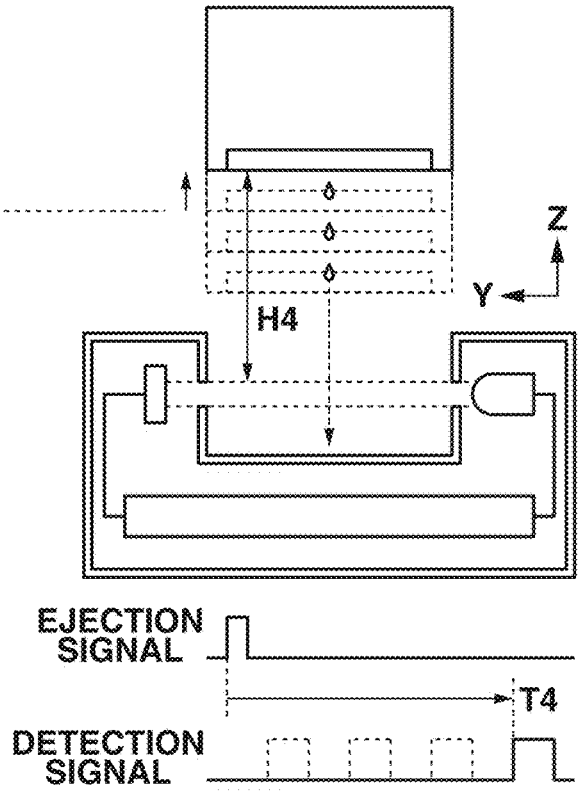

After calculating the ejection velocity V2, the sequence control unit 307 further drives the lift motor 211 to change the distance in the height direction between the ejection port surface 201*a* and the light 404 to the distance H4, which is longer than the distance H3. FIG. 12D illustrates this state. Similarly to FIGS. 12A to 12C, the sequence control unit 307 causes the ejection port of the recording head 201 to eject an ink droplet. The control circuit substrate 403 then detects a timing at which an amount of light is changed when the ejected ink droplet passes through the light 404 emitted from the droplet detection sensor 205, and outputs a detection signal. The sequence control unit 307 then detects a detection time T4 from the transmission of the ejection signal for causing the recording head 201 to eject an ink droplet until the output of the detection signal. Similarly to the cases described with reference to FIGS. 12A to 12C, the sequence control unit 307 calculates an ejection velocity V3 of an ink droplet, which passes between the ejection start point of the distance H4 and the ejection start point of the distance H3, based on a time difference between the detection time T3 and the detection time T4 and a distance difference between the distance H3 and the distance H4, by the following formula.

$$V3=(H4-H3)/(T4-T3)$$

As described above, the present exemplary embodiment calculates an ejection velocity V of an ink droplet by changing a distance between the recording head 201 and the droplet detection sensor 205, and detecting a detection time at each of distances. While the present exemplary embodiment sequentially detects detection times at corresponding distances in ascending order, the detection order is not limited thereto. For example, the present exemplary embodiment may detect detection times at corresponding distances in descending order. In the present exemplary embodiment, the distance H for separation is a distance of 1.2 mm to 2.2 mm.

The present exemplary embodiment may also calculate ejection velocities by measuring detection times at a larger number of distances between the recording head 201 and the droplet detection sensor 205. Since the present exemplary embodiment can calculate ejection velocities corresponding to a large number of distances, and can thereby acquire detailed data of influence by attenuation of an ejection velocity (whether the ejection velocity is constant or changed depending on a distance). As a result, the present exemplary embodiment can acquire the ejection velocity of ink droplets and the influence by attenuation with high accuracy.

Figure 13A:
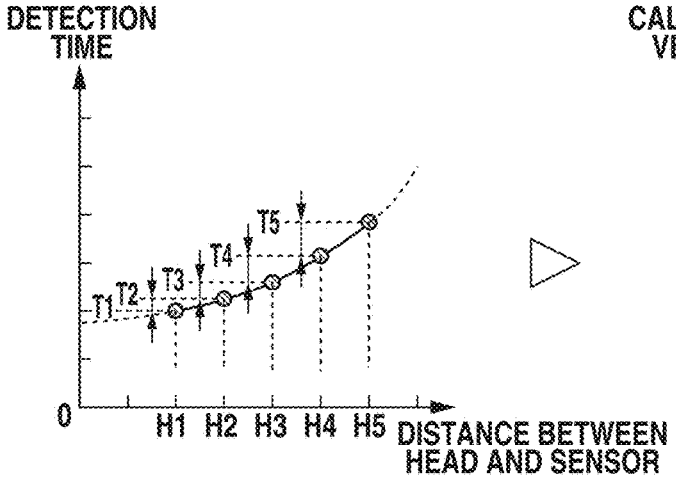
FIGS. 13A to 13D are diagrams each illustrating detection times and ejection velocities according to the second exemplary embodiment.
Figure 13B:
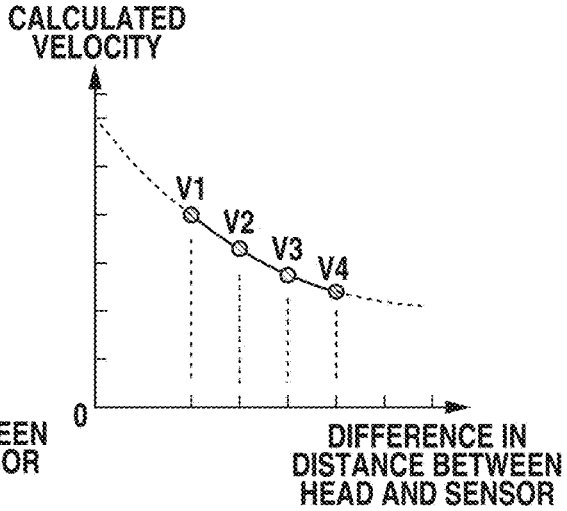
Figure 13C:
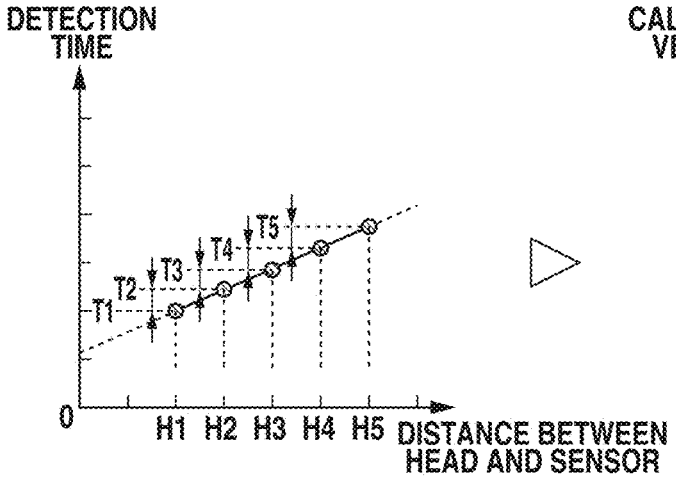
Figure 13D:
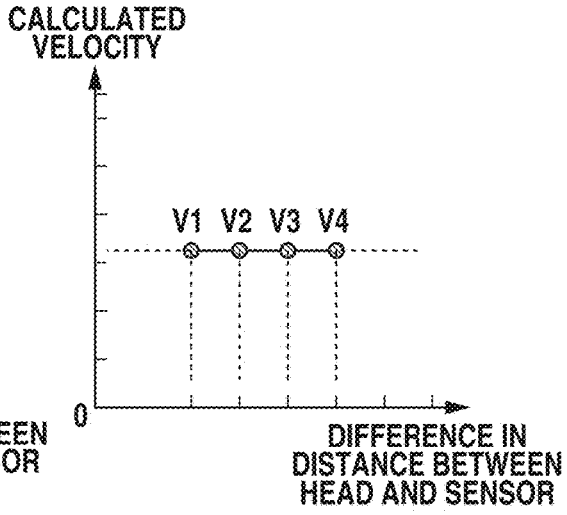

FIGS. 13A and 13C are graph charts each illustrating the distance between the ejection port surface 201*a* and the light 404 emitted from the droplet detection sensor 205, and an output result of a detection time at each distance, which is described with reference to FIGS. 12A to 12D. FIG. 13B is a graph chart illustrating a relationship between an ejection velocity, which is calculated from the distance and detection time illustrated in FIG. 13A, and a difference between corresponding distances. FIG. 13D is a graph chart illustrating a relationship between an ejection velocity, which is calculated from the distance and detection time illustrated in FIG. 13C, and a difference between corresponding distances.

In a graph illustrated in FIG. 13A, the vertical axis indicates a detection time detected by the sequence control unit 307, and the horizontal axis indicates a distance between the ejection port surface 201*a* of the recording head 201 and the light 404 emitted from the droplet detection sensor 205. A portion indicated by a hatched circle illustrated in FIG. 13A is a measured portion. In this case, the detection is performed when a distance is each of the distances H1 to H5. The distance H5 is longer than the distance H4.

In a graph chart illustrated in FIG. 13B, the vertical axis indicates an ejection velocity, and the horizontal axis indicates a difference between corresponding distances for separation. At this time, there may be a case where obtained data of the calculated ejection velocities indicates a non-linearly transition due to various kinds of influence. Hence, the present exemplary embodiment derives a quadratic or higher order polynomial of approximate curve from the acquired data of ejection velocities to calculate more accurate data of an ejection velocity at each difference between corresponding distances, and uses the polynomial of approximate curve as an expression of an ejection velocity. Three or more ejection velocities are used to perform approximate curve. To calculate three or more ejection velocities, detection times at four or more distances need to be detected. The method of seeking an ejection velocity is as described above.

It has been found from experiment by the inventors that there is also a possibility that data indicating a linear transition is obtained depending on an individual difference among recording heads, a difference in physical properties of ink colors, and furthermore, usage conditions and environmental influence. FIG. 13C illustrates data indicating such a linear transition. In this case, the present exemplary embodiment can also calculate an ejection velocity from a detection time at each distance and a difference between corresponding distances from the ejection port surface 201*a* and the light 404. FIG. 13D is a diagram illustrating a relationship between a calculated ejection velocity and a difference between corresponding distances. As illustrated in FIG. 13D, a calculated ejection velocity at each difference between corresponding distances indicates a constant ejection velocity. In a case where it is found that data indicating a linear transition can be obtained, the obtained ejection velocities indicate a constant value regardless of distances, and thus one ejection velocity is only required to be obtained. To calculate one ejection velocity, detection times at two distances are required to be detected.

Even if the ejection velocities make a non-linear transition, the present exemplary embodiment does not necessarily perform approximate curve when performing recording only in a case where the distance between the ejection port surface 201*a* and the recording medium 203 is a constant distance. In this case, the present exemplary embodiment is only required to detect detection times at two distances including a distance at which the recording is performed between the two distances.

The present exemplary embodiment executes the processing of calculating an ejection velocity, i.e., the processing of the first exemplary embodiment in steps S701 to S703 illustrated in FIG. 11, at the distances H1 to H4, and executes the processing in step S705 to calculate the ejection velocity as described above.

The present exemplary embodiment adjusts an ejection timing in a method similar to that according to the first exemplary embodiment.

<Decision of Measurement Condition>

The present exemplary embodiment executes processing of deciding a timing of setting a measurement condition similarly to the processing according to the first exemplary embodiment described with reference to FIG. 9.

The present exemplary embodiment performs measurement condition decision processing in step S502 similarly to that according to the first exemplary embodiment illustrated in FIG. 10 to decide a measurement condition. A distance between the ejection port surface 201*a* and the light 404 emitted from the light-emitting element 401, the distance being used for measuring detection times, is predetermined and stored in the memory 303, and is any of the distances H1 to H4. Alternatively, the present exemplary embodiment may measure detection times at a plurality of distances, determine stability of detection times at respective distances, and decide a measurement condition that enables the least number of consecutive ejections among the distances.

As described above, the present exemplary embodiment changes a distance between the recording head 201 and the droplet detection sensor 205, and detects a detection time from the ejection of an ink droplet until the detection of the ink droplet at each of a plurality of distances. The present exemplary embodiment then calculates an ejection velocity based on a difference between corresponding distances and a difference between detection times. The present exemplary embodiment can thereby accurately calculate an ejection velocity of an ink droplet even if the distance detection sensor 204 is not in a state of being assembled with high accuracy. The present exemplary embodiment detects detection times at four or more distances, and can thereby acquire accurate data regarding an individual difference among recording apparatuses and recording heads, a difference in physical properties of ink colors, influence by usage conditions or circumstances, and influence by attenuation of an ejection velocity at each separated distance.

In the processing described above, the present exemplary embodiment has the configuration of changing a distance by moving the recording head 201 with respect to the droplet detection sensor 205. However, the present exemplary embodiment is only required to have a configuration of relatively changing the distance in the Z-direction between the droplet detection sensor 205 and the recording head 201. Hence, the present exemplary embodiment may alternatively have a configuration of changing the distance by moving the droplet detection sensor 205 in the Z-direction.

In a case where the recording head 201 is in a state of not having ejected ink for a while, moisture of ink evaporates from a portion exposed to the air via an ejection port, and the viscosity of ink around the ejection port increases. Ejecting ink in such a state may influence an amount of ejection and an ejection velocity. A third exemplary embodiment calculates an ejection velocity in consideration of such influence. A description of a part having similar to that of the exemplary embodiments described above will be omitted.

The following description can be applied to the measurement condition decision processing in step S502 illustrated in FIG. 9, and the ejection velocity calculation processing illustrated in FIG. 11.

Figure 14:
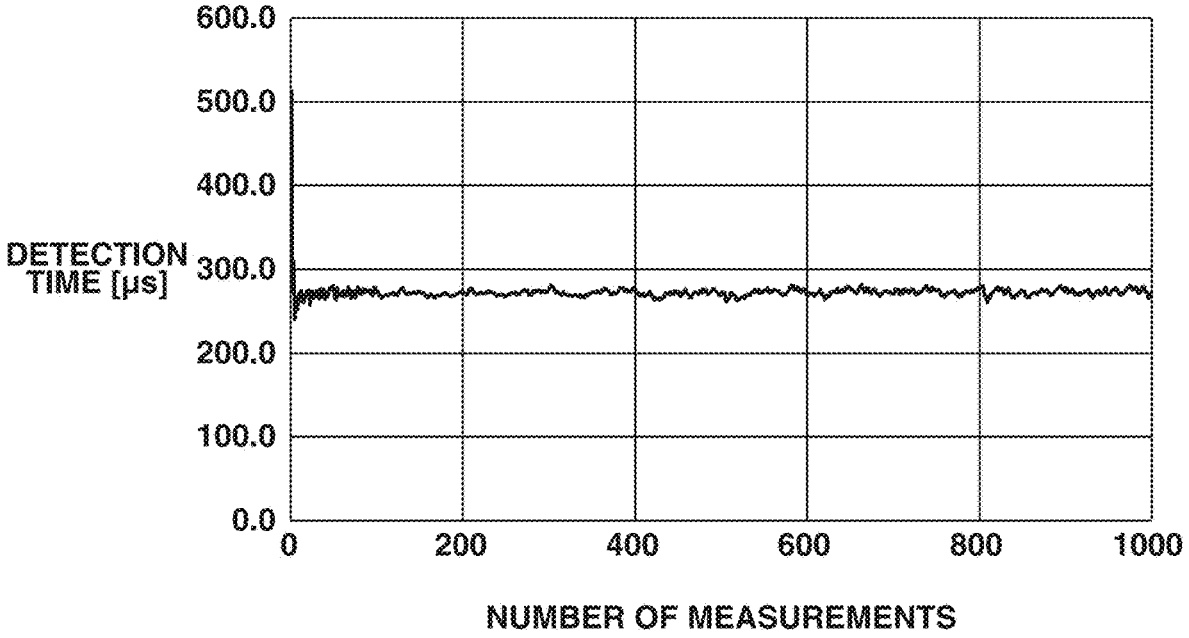
FIG. 14 is a graph indicating a relationship between a detection time and the number of measurements according to a third exemplary embodiment.

FIG. 14 is a graph illustrating a relationship between a detection time and the number of measurements when the recording head 201 starts measuring detection times in a state of not having ejected ink for a while. The measurement of the detection times at this time is performed under such a measurement condition as to decrease the influence by mist. As illustrated in FIG. 14, variations in data of detection times from the first measurement to the tenth measurement are large, and the detection times are not stable. Thus, the present exemplary embodiment excludes a predetermined number of pieces of data until detection times can be measured in a stable ejection state from data to be used for calculating an ejection velocity. The number of pieces of data to be excluded is a number predetermined by a person skilled in the art from experiment or the like. The number of pieces of data to be excluded may also be changed depending on an elapsed time from the previous ejection. The ejection velocity is calculated by the method of the exemplary embodiments described above.

The larger the number of ejections is, the higher a temperature of the recording head 201 becomes, and thus the lower the viscosity of ink becomes. Hence, even in a case where a constant amount of driving energy is applied to the recording head 201, an amount of ejected ink droplets changes depending on a temperature of the recording head 201 and a temperature of ink, and thus an ejection velocity changes. To further increase stability of detection times to be used for an ejection velocity calculation, the present exemplary embodiment may perform a simple moving averaging method per predetermined number of measurements based on measured time-series data. In this case, the present exemplary embodiment calculates an ejection velocity using data of a section determined to be stable among detection times sought by the simple moving averaging method.

Further, a configuration of assigning weights in consideration of characteristics of an ink color serving as a measurement target and influence by a surrounding circumferential change, and using a weighted moving averaging method can be applied to the present exemplary embodiment.

Further, even an apparatus that is less susceptible to mist and does not require switching of a measurement condition as described with reference to FIG. 10 may be configured to exclude data of the first several times measurements from data to be used for calculating an ejection velocity.

According to the exemplary embodiments described above, deciding the number of consecutive ejections based on a measurement result can increase accuracy of measurement.

OTHER EMBODIMENTS

Embodiment(s) of the present disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2020-103905, filed Jun. 16, 2020, which is hereby incorporated by reference herein in its entirety.

What is claimed is:

1. An ejection apparatus comprising:

an ejection head that includes an ejection port configured to eject a droplet;

a droplet detection unit configured to detect that the ejected droplet has reached a predetermined position;

an acquisition unit configured to acquire information regarding a velocity of movement of the droplet detected by the droplet detection unit;

a control unit configured to control the ejection head to eject the droplet from the ejection port; and a decision unit configured to decide a number of consecutive ejections of a plurality of droplets from the ejection head based on the information acquired by the acquisition unit regarding the velocities of each of the plurality of droplets ejected consecutively by the ejection head and detected by the droplet detection unit, and wherein, in a case where the acquisition unit acquires the information regarding velocities of droplets detected by the droplet detection unit, the control unit controls the ejection head to consecutively eject the droplets from the ejection head based on the decided number of consecutive ejections.

2. The ejection apparatus according to claim 1, further comprising a determination unit configured to determine stability of the acquired information regarding the velocities of each of the plurality of droplets detected by the droplet detection unit, wherein the decision unit decides the number of consecutive ejections of the droplets from the ejection head based on a result of the stability determination made by the determination unit.

3. The ejection apparatus according to claim 2, wherein the determination unit determines the stability of the information regarding the velocities based on a variance of the information regarding the velocities.

4. The ejection apparatus according to claim 2, wherein the acquisition unit acquires the information regarding velocities of droplets ejected by multiple times ejections including a first number of consecutive ejections, wherein, in a case where the determination unit determines that the information regarding the velocities is stable, the decision unit decides on the first number as the number of consecutive ejections of the droplets from the ejection head, wherein, in a case where the determination unit determines that the information regarding the velocities is not stable, the acquisition unit acquires, in addition to the information regarding the velocities of the respective droplets ejected by multiple times ejections, a second number of consecutive ejections where the second number of consecutive ejections is smaller than the first number of consecutive ejections, wherein, in a case where the determination unit determines that the information regarding the velocities of the respective droplets ejected by the multiple times ejections including the second number of consecutive ejections is stable, the decision unit decides on the second number as the number of consecutive ejections of the droplets from the ejection head, and wherein, in a case where the determination unit determines that the information regarding the velocities of the respective droplets ejected by the multiple times ejections including the second number of consecutive ejections is not stable, the decision unit decides on a third number, smaller than the second number, as the number of consecutive ejections of the droplets from the ejection head.

5. The ejection apparatus according to claim 2, wherein the acquisition unit acquires the information regarding velocities of droplets ejected by the multiple times ejections including a first number of consecutive ejections, wherein, in a case where the determination unit determines that the information regarding the velocities is stable, the decision unit decides on the first number as the number of consecutive ejections of the droplets from the ejection head, and wherein, in a case where the determination unit determines that the information regarding the velocities is not stable, the decision unit decides on a second number, smaller than the first number, as the number of consecutive ejections of the droplets from the ejection head.

6. The ejection apparatus according to claim 5, wherein the number of the multiple times ejections including the first number of consecutive ejections and the number of the multiple times ejections including the second number of consecutive ejections are identical.

7. The ejection apparatus according to claim 5, wherein, in a case where the number decided by the decision unit is the second number and the acquisition unit acquires the information regarding the velocities of the respective droplets detected by the droplet detection unit, the control unit controls the ejection head to perform the second number of consecutive ejections from the ejection port, controls the ejection head not to perform ejection for a period of time longer than an interval between ejections at time of continuous ejections, and controls the ejection head to perform continuous ejections from the ejection port.

8. The ejection apparatus according to claim 2, further comprising a calculation unit configured to calculate an ejection velocity of the droplet, wherein, as the information regarding the velocity, the acquisition unit acquires information indicating a time from start of the ejection of the droplet by the ejection head until detection by the droplet detection unit that the droplet has reached the predetermined position wherein the determination unit determines a section in which detected times are stable among a plurality of the times acquired by the acquisition unit, wherein the calculation unit is configured to calculate the ejection velocity of the droplet based on the time indicated by the information acquired by the acquisition unit and a distance between an ejection port surface on which the ejection port is formed and the predetermined position, and wherein the calculation unit calculates the ejection velocity of the droplet using the times detected in the section determined by the determination unit.

9. The ejection apparatus according to claim 2, further comprising a changing unit configured to change a distance between an ejection port surface on which the ejection port is formed and the predetermined position at a position where the droplet detection unit detects that the droplet ejected from the ejection head has reached the predetermined position, wherein the control unit causes the acquisition unit to:

acquire the information regarding the velocities of the respective droplets in a state where the distance between the ejection port surface and the predetermined position is a first distance, and acquire the information regarding the velocities of the respective droplets in a state where the distance between the ejection port surface and the predetermined position is changed by the changing unit to a second distance different from the first distance, wherein the determination unit determines the stability of the information regarding the velocities detected in the state of the first distance, and determines the stability of the information regarding the velocities detected in the state of the second distance, and wherein the decision unit decides the number of consecutive ejections of the droplets from the ejection head, based on the determined stability of the information regarding the velocities at the first distance and the determined stability of the information regarding the velocities at the second distance.

10. The ejection apparatus according to claim 9, wherein the decision unit decides on a fewer number of consecutive ejections as the number of consecutive ejections when the acquisition unit acquires the information regarding the velocity, wherein the fewer number of consecutive ejections is out of the number of consecutive ejections of the droplets ejected from the ejection head, wherein the number is decided based on the determined stability of the information regarding the velocities at the first distance and the number of consecutive ejections of the droplets ejected from the ejection head, and wherein the number is decided based on the determined stability of the information regarding the velocities at the second distance.

11. The ejection apparatus according to claim 9, further comprising a calculation unit configured to calculate an ejection velocity of the droplet, wherein the acquisition unit detects a first time from start of the ejection of the droplet from the ejection port in the state where the distance between the ejection port surface of the ejection head and the predetermined position is the first distance until detection of the droplet by the droplet detection unit, and detect a second time from start of the ejection of the droplet from the ejection port in the state where the distance between the ejection port surface and the predetermined position is changed by the changing unit to the second distance different from the first distance until detection of the droplet by the droplet detection unit, and wherein the calculation unit is configured to calculate the ejection velocity of the droplet based on the first distance, the second distance, the first time, and the second time.

12. The ejection apparatus according to claim 1, further comprising a detection unit including a light-emitting unit configured to emit light and a light-receiving unit configured to receive light emitted from the light-emitting unit, wherein, based on an amount of light received by the light-receiving unit, the droplet detection unit detects that the droplet ejected from the ejection head has reached the light emitted from the light-emitting unit at the predetermined position.

13. The ejection apparatus according to claim 1, further comprising a calculation unit configured to calculate an ejection velocity of the droplet, wherein, as the information regarding the velocity, the acquisition unit acquires information indicating a time from start of the ejection of the droplet by the ejection head until detection by the droplet detection unit that the droplet has reached the predetermined position, and wherein the calculation unit is configured to calculate the ejection velocity of the droplet based on the time indicated by the information acquired by the acquisition unit and a distance between an ejection port surface on which the ejection port is formed and the predetermined position.

14. The ejection apparatus according to claim 1, wherein the ejection head is configured to eject first ink and second ink, wherein the control unit is configured to cause the acquisition unit to acquire information regarding a velocity of movement of the first ink and information regarding a velocity of movement of the second ink, and wherein the decision unit is configured to decide the number of consecutive ejections of the first ink to be ejected from the ejection head based on the information acquired by the acquisition unit regarding the velocities of the respective droplets with respect to the first ink acquired by the acquisition unit, and is configured to decide the number of consecutive ejections of the second ink to be ejected from the ejection head based on the information acquired by the acquisition unit regarding the velocities of the respective droplets with respect to the second ink.

15. The ejection apparatus according to claim 1, wherein the ejection head is configured to eject first ink and second ink, wherein the control unit is configured to cause the acquisition unit to acquire information regarding a velocity of movement of the first ink and information regarding a velocity of movement of the second ink, and wherein the decision unit is configured to decide the number of consecutive ejections of the first ink and the number of consecutive ejections of the second ink from the ejection head, based on the information acquired by the acquisition unit regarding the velocities of the respective droplets with respect to the first ink.

16. The ejection apparatus according to claim 1, further comprising a storage unit configured to store the decided number of consecutive ejections of the droplets from the ejection head.

17. The ejection apparatus according to claim 1, further comprising:

an ejection signal generating unit configured to generate an ejection signal; and a driving pulse generating unit configured to generate a driving pulse to eject the droplet from the ejection port of the ejection head in accordance with input of the ejection signal, wherein the ejection head ejects the droplet from the ejection port by the driving pulse being applied to the ejection head, wherein, as the information regarding the velocity, the acquisition unit acquires information indicating a time from start of the ejection of the droplet by the ejection head until detection by the droplet detection unit that the droplet has reached the predetermined position, and wherein the acquisition unit acquires the information indicating the time with a timing at which the ejection signal generating unit inputs the ejection signal to the driving pulse generating unit being a timing of the start of the ejection of the droplet from the ejection port.

18. A method for an ejection apparatus having ejection head that includes an ejection port, the method comprising:

ejecting a droplet via the ejection port;

detecting that the ejected droplet has reached a predetermined position;

acquiring information regarding a velocity of movement of the detected droplet;

wherein ejecting includes ejecting consecutively a plurality of droplets from the ejection port, wherein acquiring includes acquiring information regarding velocities for each of the plurality of droplets consecutively ejected in the ejection; and deciding a number of consecutive ejections of the plurality of droplets from the ejection head based on the information regarding the velocities acquired in the acquisition, wherein, when information regarding velocities of droplets detected in the droplet detection is acquired in the acquisition, ejecting includes ejecting the number of times decided in the decision.

19. The method of ejecting a droplet according to claim 18, further comprising determining stability of the acquired information regarding the velocities, wherein deciding includes deciding the number of consecutive ejections of the droplets from the ejection head for detecting a time based on a result of the stability determination.

* * * * *